US011376846B2

(12) United States Patent
Takeuchi et al.

(10) Patent No.: US 11,376,846 B2
(45) Date of Patent: Jul. 5, 2022

(54) LIQUID DISCHARGING APPARATUS

(71) Applicant: Seiko Epson Corporation, Tokyo (JP)

(72) Inventors: Yuko Takeuchi, Shiojiri (JP); Yuta Takigami, Shiojiri (JP); Hideaki Nishimura, Nagano (JP); Katsuhiko Otani, Shimosuwa (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/104,035

(22) Filed: Nov. 25, 2020

(65) Prior Publication Data

US 2021/0154995 A1 May 27, 2021

(30) Foreign Application Priority Data

Nov. 27, 2019 (JP) ..... JP2019-214343

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC . B41J 2/04541; B41J 2/0458; H01L 41/0477; G05B 19/40
See application file for complete search history.

(56) References Cited

U.S. PATENT DOCUMENTS 5,977,739 A * 11/1999 Ohsawa ..... G05B 19/40 318/400.27
10,160,201 B2 * 12/2018 Nakajima ..... H01L 41/0477
2018/0178510 A1 6/2018 Nakajima
2018/0272700 A1 9/2018 Ito et al.

FOREIGN PATENT DOCUMENTS

JP 2018-158487 A 10/2018

* cited by examiner

*Primary Examiner* — Lam S Nguyen
(74) *Attorney, Agent, or Firm* — Harness, Dickey & Pierce, P.L.C.

(57) ABSTRACT

A liquid discharging apparatus includes: a discharging head that discharges liquid onto a medium; first and second components that are operable for discharging the liquid onto the medium; first and second control circuits that control driving of the discharging head; a first control circuit board on which the first control circuit is provided; a second control circuit board on which the second control circuit is provided; wherein the first component is electrically coupled to the first control circuit, the second component is electrically coupled to the second control circuit, a minimum distance between the first control circuit board and the first component is shorter than a minimum distance between the first control circuit board and the second component, and a minimum distance between the second control circuit board and the second component is shorter than a minimum distance between the second control circuit board and the first component.

6 Claims, 13 Drawing Sheets

| [SIH, SIL] | | [1, 1] LARGE DOT | [1, 0] MEDIUM-SIZED DOT | [0, 1] SMALL DOT | [0, 0] NON-PRINTING |
|---|---|---|---|---|---|
| S1 | T1 | H | H | H | L |
| | T2 | H | L | L | L |
| S2 | T1 | L | L | L | H |
| | T2 | L | H | L | L |

LIQUID DISCHARGING APPARATUS

The present application is based on, and claims priority from JP Application Serial Number 2019-214343, filed Nov. 27, 2019, the disclosure of which is hereby incorporated by reference herein in its entirety.

BACKGROUND

1. Technical Field

Embodiments of the present disclosure relate to a liquid discharging apparatus.

2. Related Art

In an ink-jet printer as an example of a liquid discharging apparatus, control signals generated in control circuitry, etc. provided in the body of the ink-jet printer are sent to a print head (discharging head) that has nozzles for discharging ink, and the timing of discharging the ink is controlled based on the control signals so as to print an image and/or a text, etc. on a medium.

For example, the following liquid discharging apparatus is disclosed in JP-A-2018-158487. A control signal generation unit that is control circuitry generates control signals corresponding to image data supplied from an external host computer. The liquid discharging apparatus forms an image that includes characters, figures, etc. corresponding to the supplied image data on a medium by controlling, based on the control signals, the transportation of the medium such as paper and the driving of various components included in the liquid discharging apparatus, for example, a head that discharges ink.

However, in the liquid discharging apparatus disclosed in JP-A-2018-158487, the various components of the liquid discharging apparatus, which are driven by the control signals outputted from the control circuitry, are scattered here and there inside the liquid discharging apparatus. Because of the scattered layout, wiring via which the control signals propagate is inevitably long. Consequently, there is a risk of a decrease in the quality of an image formed on a medium because the propagation precision of the control signals will decrease due to the influence of wiring impedance, etc.

SUMMARY

A liquid discharging apparatus according to a certain aspect includes: a discharging head that discharges liquid onto a medium by being driven; first and second components that are operable for discharging the liquid onto the medium; first and second control circuits that control driving of the discharging head; a first control circuit board on which the first control circuit is provided; a second control circuit board on which the second control circuit is provided; wherein the first component is electrically coupled to the first control circuit, the second component is electrically coupled to the second control circuit, a minimum distance between the first control circuit board and the first component is shorter than a minimum distance between the first control circuit board and the second component, and a minimum distance between the second control circuit board and the second component is shorter than a minimum distance between the second control circuit board and the first component.

The liquid discharging apparatus according to the certain aspect may further include: a housing that houses the first component, the second component, the first control circuit board, and the second control circuit board; and a transportation section that transports the medium onto which the liquid is discharged from the discharging head; wherein the housing may have a first face and a second face, the first face and the second face may be located with at least a partial overlap in a width direction of the medium intersecting with a transportation direction in which the medium is transported by the transportation section, a minimum distance between the first control circuit board and the first face may be shorter than a minimum distance between the first control circuit board and the second face, and a minimum distance between the second control circuit board and the second face may be shorter than a minimum distance between the second control circuit board and the first face.

In the liquid discharging apparatus according to the certain aspect, the minimum distance between the first control circuit board and the first face may be shorter than a minimum distance between the transportation section and the first face, and the minimum distance between the second control circuit board and the second face may be shorter than a minimum distance between the transportation section and the second face.

The liquid discharging apparatus according to the certain aspect may further include: a drive signal output circuit that outputs a drive signal for driving the discharging head; and a drive circuit board on which the drive signal output circuit is provided; wherein the second component may include the drive circuit board.

In the liquid discharging apparatus according to the certain aspect, the second component may include an electric motor that converts electric energy into kinetic energy.

In the liquid discharging apparatus according to the certain aspect, the driving of the discharging head may be controlled based on an image signal inputted from an input terminal, and the first component may include the input terminal.

In the liquid discharging apparatus according to the certain aspect, there may be a first mode in which it is possible to discharge the liquid from the discharging head and a second mode in which power consumption is smaller than in the first mode and the liquid is not discharged from the discharging head, and operation of the second control circuit may be stopped in the second mode.

DESCRIPTION OF EXEMPLARY EMBODIMENTS

With reference to the accompanying drawings, a certain non-limiting advantageous embodiment of the present disclosure will now be explained. The drawings will be referred to in order to facilitate an explanation. The specific embodiment described below shall never be construed to unduly limit the scope of the present disclosure recited in the appended claims. Not all of components described below necessarily constitute indispensable parts of the present disclosure.

In the present embodiment, an ink-jet printer capable of performing printing on a large-sized medium having a shorter-side width of A3 (297 mm) or larger, a so-called large format printer, is taken as an example of a liquid discharging apparatus for the purpose of explanation. In addition, roll paper, which is formed by wrapping paper around a core into a shape of a roll, is taken as an example of a medium onto which the liquid discharging apparatus according to the present embodiment discharges ink. The type of a medium onto which the liquid discharging apparatus discharges ink is not limited to roll paper. For example, sheets of paper cut into a predetermined size may be used. A cloth or other materials may be used.

1. Structure of Liquid Discharging Apparatus

Figure 1:
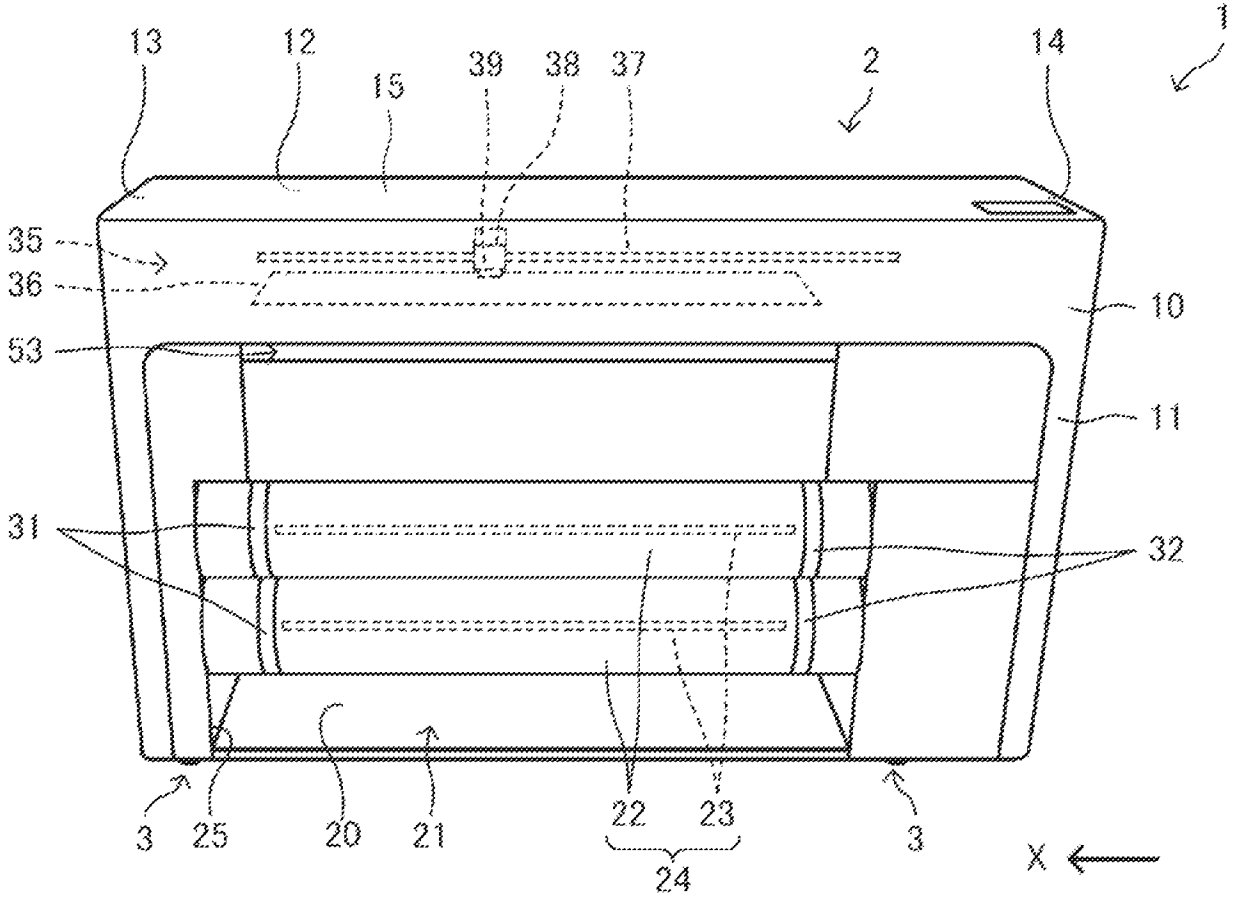
FIG. 1 is an overall perspective view illustrating the appearance and external structure of a liquid discharging apparatus.
Figure 2:
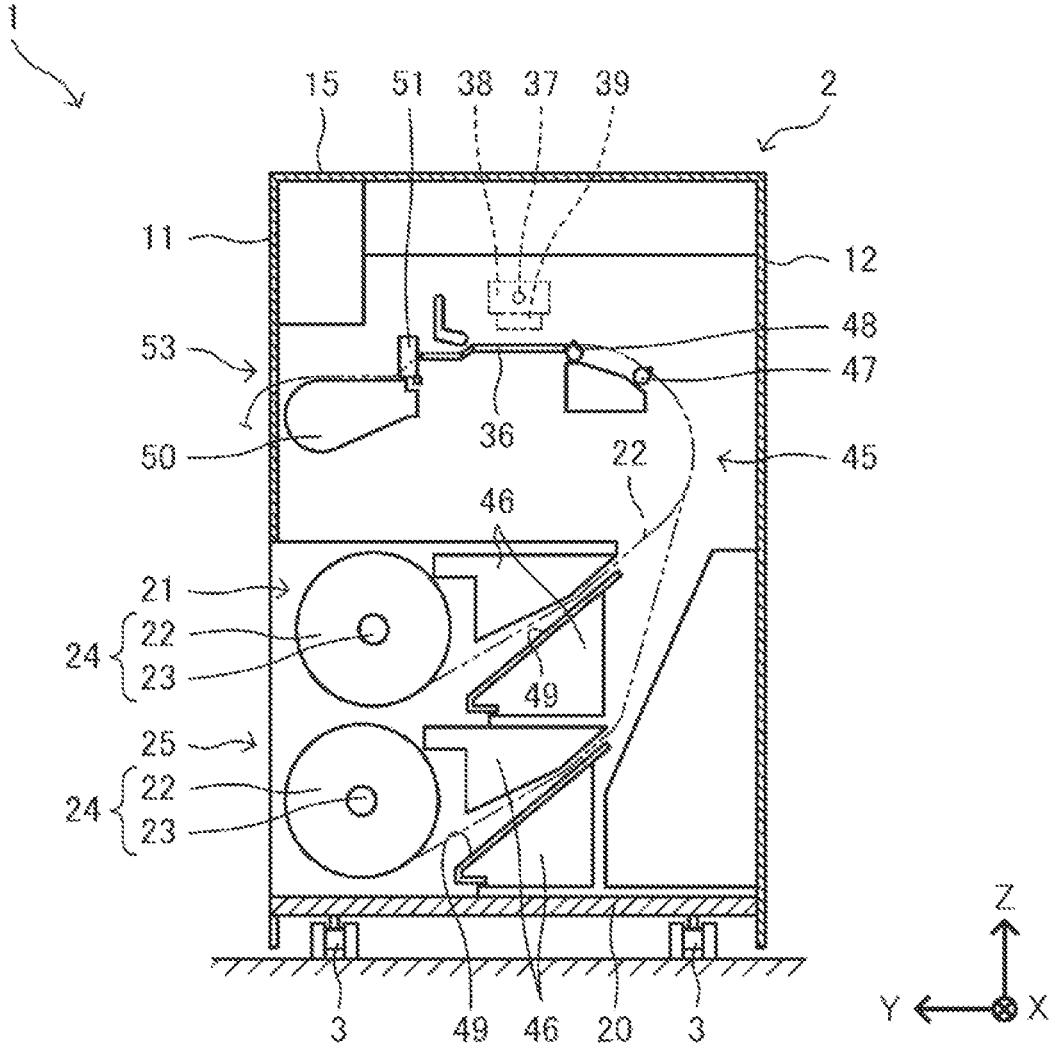
FIG. 2 is a sectional view schematically illustrating a part of the internal structure of the liquid discharging apparatus.
Figure 3:
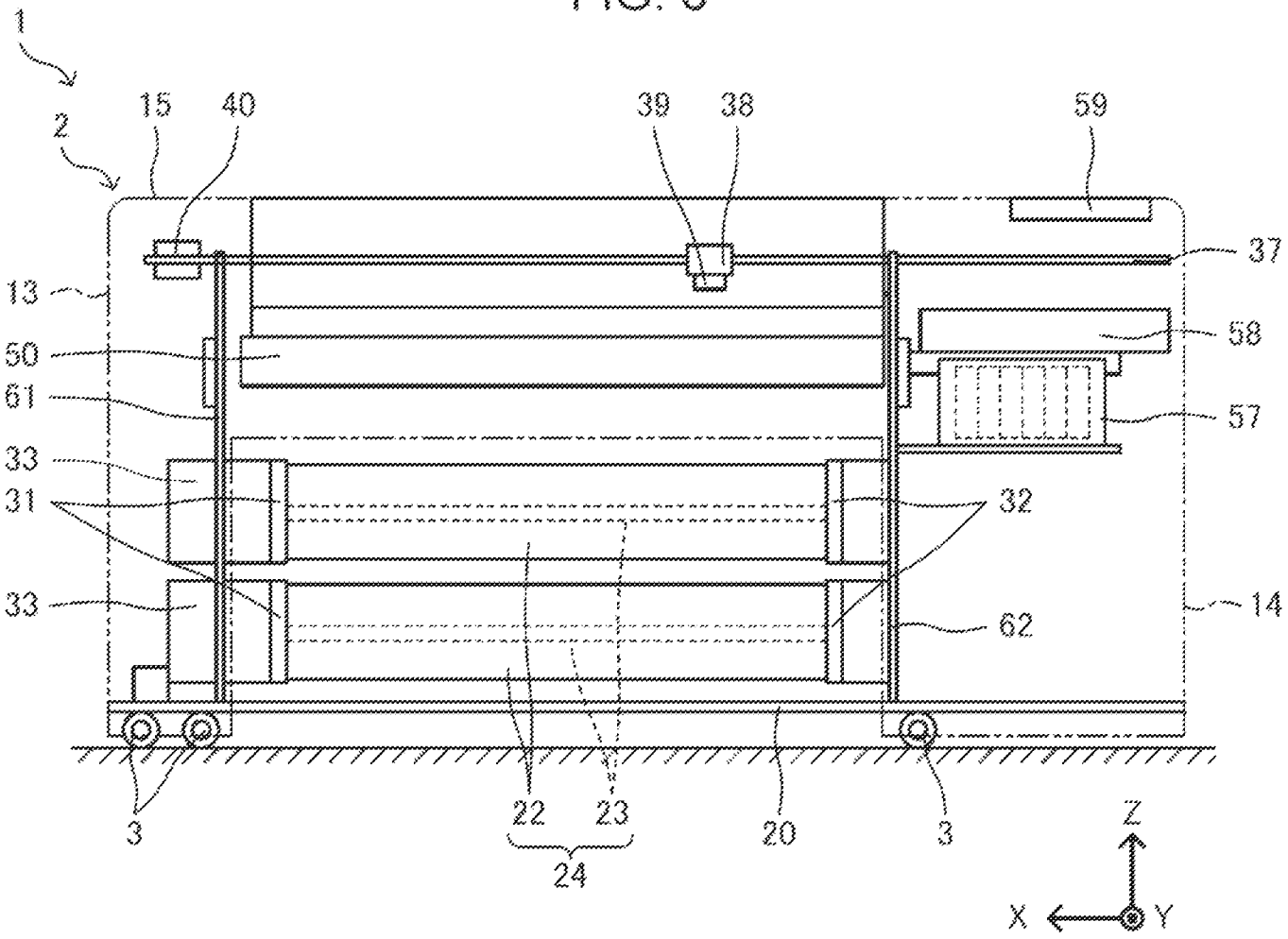
FIG. 3 is an overall view schematically illustrating a part of the internal structure of the liquid discharging apparatus.

With reference to FIGS. 1, 2, and 3, the appearance and structure of a liquid discharging apparatus 1 according to the present embodiment will now be explained. FIG. 1 is an overall perspective view illustrating the appearance and external structure of the liquid discharging apparatus 1. FIG. 2 is a sectional view schematically illustrating a part of the internal structure of the liquid discharging apparatus 1. FIG. 3 is an overall view schematically illustrating a part of the internal structure of the liquid discharging apparatus 1.

As illustrated in FIG. 1, the liquid discharging apparatus 1 includes a body 2 and a plurality of foots 3. The body 2 includes a housing 10 that has a shape of substantially rectangular parallelepiped. The housing 10 includes a front wall 11, a rear wall 12, a first sidewall 13, a second sidewall 14, and a top wall 15. The housing 10 is connected to a base frame 20 supported by the foots 3.

In the liquid discharging apparatus 1, a direction in which the base frame 20 and the top wall 15 face each other is defined as a height direction of the liquid discharging apparatus 1, a direction in which the first sidewall 13 and the second sidewall 14 face each other along a plane orthogonal to the height direction is defined as a width direction, and a direction in which the front wall 11 and the rear wall 12 face each other along a plane orthogonal to the height direction is defined as a depth direction. In the liquid discharging apparatus 1, the height direction is parallel to the direction of gravity when the width direction and the depth direction are on a horizontal plane. In the explanation below, the width direction is depicted as the X direction, the depth direction is depicted as the Y direction, and the height direction is depicted as the Z direction. The directional side indicated by the head of an arrow in the illustrated X direction may be referred to as "+X side", and the directional side indicated by the tail of the arrow in the illustrated X direction may be referred to as "−X side". The directional side indicated by the head of an arrow in the illustrated Y direction may be referred to as "+Y side", and the directional side indicated by the tail of the arrow in the illustrated Y direction may be referred to as "−Y side". Similarly, the directional side indicated by the head of an arrow in the illustrated Z direction may be referred to as "+Z side", and the directional side indicated by the tail of the arrow in the illustrated Z direction may be referred to as "−Z side".

As illustrated in FIGS. 1 and 2, the body 2 has a container portion 21. The container portion 21 houses a cylindrical roll 24 formed by wrapping, around a core member 23, a medium 22 on which an image is to be formed by the body 2. Specifically, the container portion 21 is capable of accommodating a pair of rolls 24 arranged next to each other in the Z direction of the liquid discharging apparatus 1. The container portion 21 has an opening 25 through the front wall 11 of the housing 10 at a position closer to the base frame 20, and is formed from the front wall 11 toward the rear wall 12.

As illustrated in FIGS. 1, 2, and 3, each of the pair of rolls 24 housed in the container portion 21 is rotatably mounted in the body 2, and a first holder portion 31, which holds one end of the roll 24, and a second holder portion 32, which holds the other end of the roll 24, are attached in such a way as to be detachable from the body 2 through the opening 25. When the first holder portion 31 and the second holder portion 32 are attached to the body 2, the first holder portion 31 and the second holder portion 32 are arranged linearly along the X direction inside the container portion 21. Each roll 24 is set in place into the container portion 21, with the first holder portion 31 fixed to one end of the roll 24, and with the second holder portion 32 fixed to the other end of the roll 24. By this means, the pair of rolls 24 is positioned stably, with the first holder portion 31 and the second holder portion 32 arranged linearly along the X direction.

The first holder portion 31 is attached to a first side frame 61 illustrated in FIG. 3 rotatably around a rotation axis extending in the X direction, that is, the width direction. The second holder portion 32 is attached to a second side frame 62 illustrated in FIG. 3 rotatably around a rotation axis extending in the X direction, that is, the width direction. In other words, the first holder portion 31 and the second holder portion 32 hold the roll 24 rotatably around the center axis of the core member 23.

The roll 24 held by the first holder portion 31 and the second holder portion 32 is driven to rotate by a driver portion 33 illustrated in FIG. 3. The driver portion 33 is located closer to the first sidewall 13 than the first holder portion 31. The driver portion 33 includes a drive motor that is not illustrated. By rotation of the drive motor in the forward direction, the driver portion 33 causes the first holder portion 31 and the second holder portion 32 to rotate in such a way as to unreel the medium 22 from the roll 24 inside the housing 10 toward the rear wall 12.

As illustrated in FIGS. 1, 2, and 3, a recording portion 35 is provided inside the housing 10. The recording portion 35 includes a platen 36, a guide shaft 37, a carriage 38, and a head 39.

The platen 36 is located closer to the top wall 15 than the container portion 21. The platen 36 is a plate-shaped member extending in the X direction inside the housing 10. The medium 22 unreeled from the roll 24 is transported to the platen 36 inside the housing 10 and is thereafter transported over the platen 36 in a direction from the rear wall 12 toward the front wall 11.

The guide shaft 37 is located closer to the top wall 15 than the platen 36. The guide shaft 37 is a rod-shaped member extending in the X direction. The guide shaft 37 supports the carriage 38. In other words, the carriage 38 is supported in such a way as to be movable along the guide shaft 37. The carriage 38 is driven by a carriage motor 40 that includes a drive motor that is not illustrated. The carriage 38, when driven, reciprocates along the guide shaft 37. The head 39 is mounted on the face of the carriage 38 facing toward the platen 36. The head 39 discharges ink toward the medium 22 supported on the platen 36 at predetermined discharge timing. As a result, an image is formed on the medium 22.

As illustrated in FIG. 2, the body 2 includes a transportation portion 45. Cooperating with the first holder portion 31 and the second holder portion 32 and the driver portion 33 inside the housing 10, the transportation portion 45 transports the medium 22 unreeled from the roll 24. The transportation portion 45 includes a transportation path forming portion 46, an intermediate roller 47, and a transportation roller 48.

The transportation path forming portion 46 is provided individually for each of the pair of rolls 24. The transportation path forming portion 46 is located closer to the rear wall 12 than each of the pair of rolls 24 housed in the container portion 21. The transportation path forming portion 46 forms a transportation path 49 for guiding, toward the rear wall 12 of the housing 10, the medium 22 unreeled from the roll 24 by rotational drive operation of the first holder portion 31 and the second holder portion 32.

The intermediate roller 47 and the transportation roller 48 transport the medium 22 having passed through the transportation path 49. Each of the intermediate roller 47 and the transportation roller 48 includes a driving roller and a driven roller that constitute a pair of rollers supported rotatably around respective rotation axes extending in the X direction. Each of the intermediate roller 47 and the transportation roller 48 supports the medium 22 by nipping the medium 22 between the driving roller and the driven roller.

The transportation portion 45 includes a drive motor that is not illustrated. The intermediate roller 47 and the transportation roller 48 are driven to rotate due to rotation of the drive motor in the forward direction. As a result, the medium 22 is transported to the platen 36 along the transportation path 49 and is thereafter transported over the platen 36 in a direction from the rear wall 12 toward the front wall 11. Although FIG. 2 illustrates a state of unreeling the medium 22 from both of the pair of rolls 24, the medium 22 may be unreeled from only one of the pair of rolls 24 when image forming operation is performed.

As illustrated in FIG. 2, a paper ejection port member 50 and a cutter portion 51 are provided inside the housing 10. The paper ejection port member 50 is located closer to the front wall 11 than the platen 36. The paper ejection port member 50 supports the medium 22 having passed through the platen 36 and transports the medium 22 to a paper ejection port 53 formed through the front wall 11. The cutter portion 51 cuts the medium 22 into a predetermined size. The medium 22 cut by the cutter portion 51 is ejected to the outside through the paper ejection port 53.

As illustrated in FIG. 3, the body 2 includes an attachment portion 57 to which cartridges containing ink to be supplied to the head 39 are attached. The attachment portion 57 is located closer to the second sidewall 14 than the first holder portion 31 and the second holder portion 32, and is located closer to the top wall 15 than the first holder portion 31 and the second holder portion 32. The cartridges are connected to the head 39 via tubes or the like that are not illustrated. Ink is supplied from the cartridges to the head 39 via the tubes when internal pressure in the head 39 decreases due to discharging ink.

The body 2 further includes a maintenance unit 58 for maintenance of the head 39. The maintenance unit 58 is located closer to the second sidewall 14 and the top wall 15 than the first holder portion 31 and the second holder portion 32, and is located closer to the base frame 20 than the head 39.

As illustrated in FIGS. 1 and 3, the body 2 has an operation portion 59. The operation portion 59 is provided on the top wall 15 of the housing 10. The operation portion 59 may be, for example, a touch panel, and is used by a user for inputting various kinds of information.

As explained above, in the liquid discharging apparatus 1 according to the present embodiment, the drive operation of the drive motor of the driver portion 33 drives the first holder portion 31 and the second holder portion 32, and the drive operation of the drive motor of the transportation portion 45 drives the intermediate roller 47 and the transportation roller 48. This transports the medium 22 included in the cylindrical roll 24 to the platen 36 via the transportation path forming portion 46.

Either one of the driver portion 33 and the transportation portion 45, which unreel and transport the medium 22 onto which ink droplets are to be ejected from the head 39, is, or both are, an example of a transportation section. The direction in which the medium 22 is transported by either one or both of the driver portion 33 and the transportation portion 45 along the Y direction is an example of a transportation direction. The direction along the X direction intersecting with the Y direction is an example of a width direction of the medium 22. The housing 10 included in the liquid discharging apparatus 1 is an example of a housing. Among the front wall 11, the rear wall 12, the first sidewall 13, the second sidewall 14, and the top wall 15 of the housing 10, the first sidewall 13 and the second sidewall 14 are located with at least a partial overlap as viewed along the X direction. The second sidewall 14 is an example of a first face of the housing 10. The first sidewall 13 is an example of a second face of the housing 10.

2. Electric Configuration of Liquid Discharging Apparatus

Figure 4A:
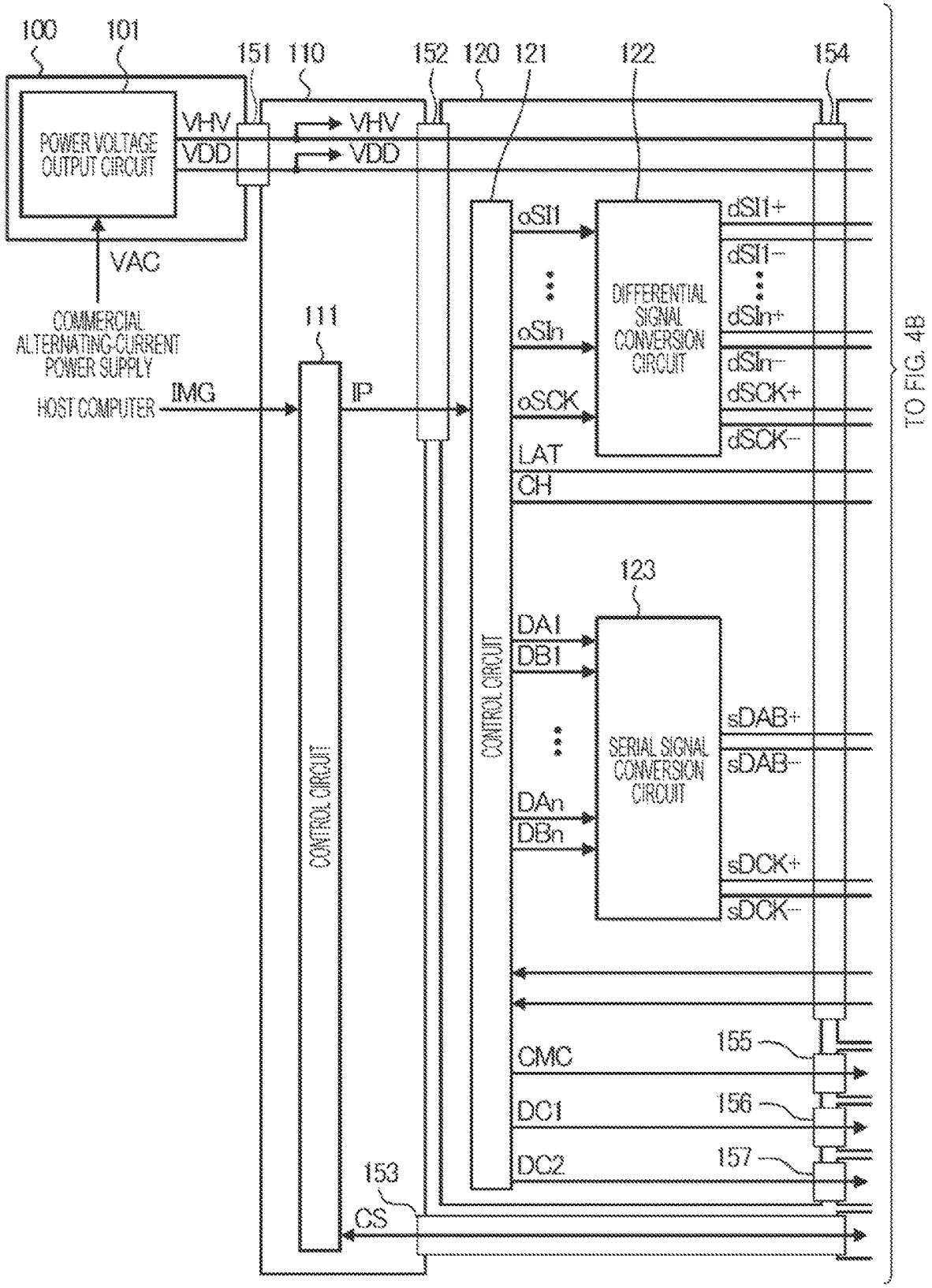
FIGS. 4A, 4B is a set of diagrams that illustrates an electric configuration of the liquid discharging apparatus.
Figure 4B:
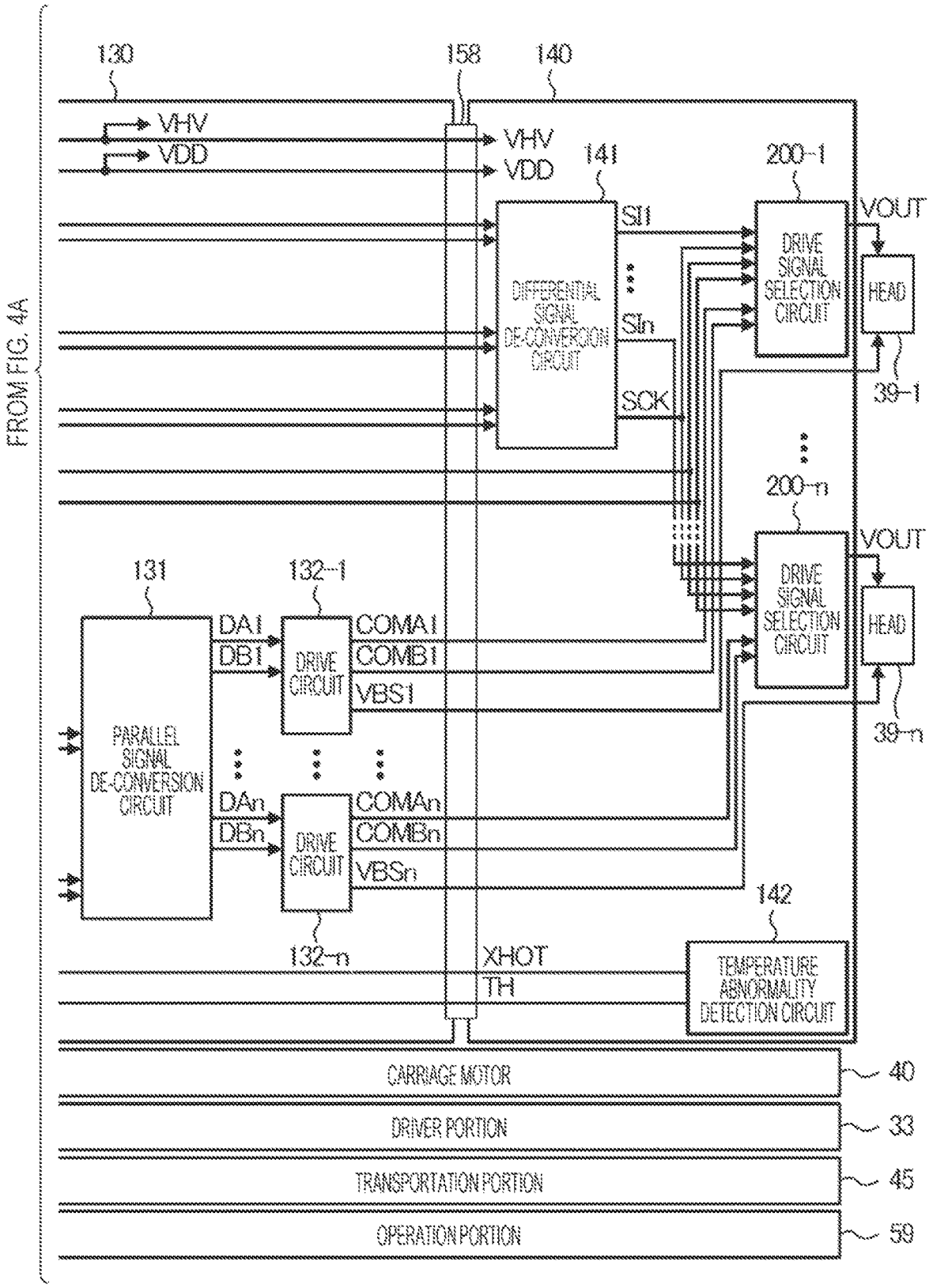

Next, with reference to FIGS. 4A, 4B, an electric configuration of the liquid discharging apparatus 1 will now be explained. FIGS. 4A, 4B is a set of diagrams that illustrates an electric configuration of the liquid discharging apparatus 1. As illustrated in FIGS. 4A, 4B, the liquid discharging apparatus 1 includes a power supply circuit board 100, a first control circuit board 110, a second control circuit board 120, a drive circuit board 130, a discharge control circuit board 140, and a plurality of heads 39.

A power voltage output circuit 101 is mounted on the power supply circuit board 100. A voltage VAC is inputted into the power voltage output circuit 101 from a commercial alternating-current power supply provided outside the liquid discharging apparatus 1. The power voltage output circuit 101 converts the inputted voltage VAC into a plurality of direct-current voltages including a voltage VHV, which is a direct-current voltage of 42 V, and a voltage VDD, which is a direct-current voltage of 3.3 V. That is, the power voltage output circuit 101 is an AC/DC converter that converts an alternating-current voltage into a direct-current voltage and includes, for example, a flyback circuit, etc. The power voltage output circuit 101 may generate the voltage VDD by lowering the voltage VHV after generating the voltage VHV. The power voltage output circuit 101 may generate a plurality of direct-current voltages by raising or lowering the voltage VHV, VDD. The voltage VHV, VDD outputted from the power supply circuit board 100 is inputted into the first control circuit board 110 via a cable 151.

A control circuit 111 is mounted on the first control circuit board 110. The control circuit 111 operates by using, as its power, a direct-current voltage that is based on the voltage VHV, VDD. An image signal IMG is inputted into the control circuit 111 from a host computer provided outside the liquid discharging apparatus 1. After performing image processing based on the image signal IMG, the control circuit 111 outputs the image-processed information as an image processing signal IP to the second control circuit board 120 via a cable 152. Examples of the image processing performed by the control circuit 111 are: color conversion processing of converting the inputted image signal IMG into color information of red, green, and blue, abbreviated as RGB, and further converting the color information RGB into color information ICMY corresponding to the colors of ink contained in the cartridges, and halftone processing of rendering the color information ICMY into processed signals of halftones.

The control circuit 111 is electrically coupled to the operation portion 59 described above. An operation information signal CS including information inputted by a user by operating the operation portion 59 is inputted into the control circuit 111 via a cable 153. The control circuit 111 generates a signal for performing control corresponding to the operation information signal CS and outputs the generated signal to the second control circuit board 120 in addition to the image processing signal IP or as a signal different from the image processing signal IP.

The control circuit 111 may output the image processing signal IP after conversion into a pair of differential signals to the second control circuit board 120. The control circuit 111 may output the image processing signal IP after conversion into a light signal, etc. to the second control circuit board 120. The image processing performed by the control circuit 111 is not limited to the color conversion processing and the halftone processing described above. The control circuit 111 may output, as the image processing signal IP, a signal(s) subjected to various kinds of image processing.

A control circuit 121, a differential signal conversion circuit 122, and a serial signal conversion circuit 123 are mounted on the second control circuit board 120. The control circuit 121, the differential signal conversion circuit 122, and the serial signal conversion circuit 123 operates by using a direct-current voltage based on the voltage VHV, VDD as its power voltage.

The control circuit 121 outputs a control signal for controlling each component of the liquid discharging apparatus 1, based on the image processing signal IP inputted from the first control circuit board 110. Specifically, based on the image processing signal IP, the control circuit 121 generates an original clock signal oSCK and original print data signals oSI1 to oSIn as control signals for controlling the discharging of ink from the head 39, and outputs these signals to the differential signal conversion circuit 122.

The differential signal conversion circuit 122 converts the inputted original clock signal oSCK into a pair of differential signals dSCK+ and dSCK−, and outputs them to the drive circuit board 130 via a cable 154. In addition, the differential signal conversion circuit 122 converts each of the inputted original print data signals oSI1 to oSIn into the corresponding one of pairs of differential signals dSI1+ to dSIn+ and dSI1− to dSIn−, and outputs them to the drive circuit board 130 via the cable 154. The differential signals dSCK+ and dSCK− and the differential signals dSI1+ to dSIn+ and dSI1− to dSIn− after conversion by the differential signal conversion circuit 122 may be differential signals conforming to the LVDS (Low Voltage Differential Signaling) transfer scheme or may be any of various high-speed transfer schemes other than LVDS such as LVPECL (Low Voltage Positive Emitter Coupled Logic) or CML (Current Mode Logic).

Based on the image processing signal IP inputted from the first control circuit board 110, the control circuit 121 generates a latch signal LAT and a change signal CH as control signals for controlling the timing of discharging ink from the head 39, and outputs them to the drive circuit board 130 via the cable 154.

Moreover, based on the image processing signal IP inputted from the first control circuit board 110, the control circuit 121 generates base drive signals DA1 to DAn and DB1 to DBn, on which drive signals COMA and COMB for driving the head 39 are based, and outputs them to the serial signal conversion circuit 123.

The serial signal conversion circuit 123 converts the base drive signals DA1 to DAn and DB1 to DBn, which are inputted as signals in a parallel format, into signals in a serial format. The serial signal conversion circuit 123 further converts the converted signals in the serial format into a pair of differential signals sDAB+ and sDAB−, and outputs them to the drive circuit board 130 via the cable 154. In addition, the serial signal conversion circuit 123 generates a pair of differential signals sDCK+ and sDCK−, which contain clock cueing the timing of de-conversion when the pair of differential signals sDAB+ and sDAB− containing the base drive signals DA1 to DAn and DB1 to DBn serially is converted back into the signals in the parallel format, and outputs them to the drive circuit board 130 via the cable 154.

The control circuit 121 generates a carriage control signal CMC for controlling the driving of the carriage motor 40 configured to control the movement of the carriage 38. The control circuit 121 outputs the carriage control signal CMC to the carriage motor 40 via a cable 155. By this means, the non-illustrated drive motor included in the carriage motor 40 operates. The control circuit 121 generates a drive control signal DC1 for controlling the non-illustrated drive motor included in the driver portion 33 configured to control the transportation of the medium 22, and outputs the drive control signal DC1 to the driver portion 33 via a cable 156. The control circuit 121 further generates a drive control signal DC2 for controlling the non-illustrated drive motor included in the transportation portion 45 configured to control the transportation of the medium 22, and outputs the drive control signal DC2 to the transportation portion 45 via a cable 157. That is, the control circuit 121 generates control signals for controlling the movement of the carriage 38 and controlling the transportation of the medium 22, and outputs the control signals to the corresponding components.

A parallel signal de-conversion circuit 131 and a plurality n of drive circuits 132-1 to 132-*n* are mounted on the drive circuit board 130. The pair of differential signals sDAB+ and sDAB− and the pair of differential signals sDCK+ and sDCK− outputted from the serial signal conversion circuit 123 of the second control circuit board 120 are inputted into the parallel signal de-conversion circuit 131. The parallel signal de-conversion circuit 131 generates the base drive signals DA1 to DAn and DB1 to DBn in the parallel format by de-converting the pair of differential signals sDAB+ and sDAB− at the timing cued by the inputted pair of differential signals sDCK+ and sDCK−. Then, the parallel signal de-conversion circuit 131 outputs the generated base drive signals DA1 to DAn and DB1 to DBn to the drive circuits 132-1 to **132-*n*** respectively.

The base drive signals DA1 and DB1 are inputted into the drive circuit 132-1. The drive circuit 132-1 converts the inputted base drive signal DA1 into an analog signal. After the conversion, the drive circuit 132-1 performs class-D amplification on the converted analog signal, thereby generating and outputting a drive signal COMA1 to the discharge control circuit board 140 via a cable 158. The drive circuit 132-1 converts the inputted base drive signal DB1 into an analog signal. After the conversion, the drive circuit 132-1 performs class-D amplification on the converted analog signal, thereby generating and outputting a drive signal COMB1 to the discharge control circuit board 140 via the cable 158. The drive circuit 132-1 generates a reference voltage signal VBS1, which serves as a reference when the head 39 described later discharges ink, and outputs it to the discharge control circuit board 140 via the cable 158.

Similarly, the base drive signals DA1 and DB1 are inputted into the drive circuit **132-*n*. The drive circuit 132-*n* converts the inputted base drive signal DAn into an analog signal. After the conversion, the drive circuit 132-*n* performs class-D amplification on the converted analog signal, thereby generating and outputting a drive signal COMAn to the discharge control circuit board 140. The drive circuit 132-*n* converts the inputted base drive signal DBn into an analog signal. After the conversion, the drive circuit 132-*n* performs class-D amplification on the converted analog signal, thereby generating and outputting a drive signal COMBn to the discharge control circuit board 140. The drive circuit 132-*n* generates a reference voltage signal VBSn, which serves as a reference when the head 39 described later discharges ink, and outputs it to the discharge control circuit board 140**.

The differential signals dSCK+ and dSCK−, the differential signals dSI1+ to dSIn+ and dSI1− to dSIn−, the latch signal LAT, the change signal CH, and the voltages VHV and VDD, which are inputted from the second control circuit board 120, propagate through the drive circuit board 130. After propagating through the drive circuit board 130, the differential signals dSCK+ and dSCK−, the differential signals dSI1+ to dSIn+ and dSI1− to dSIn−, the latch signal LAT, the change signal CH, and the voltages VHV and VDD are outputted to the discharge control circuit board 140. That is, the drive circuit board 130 behaves also as a relay board that relays the signals outputted from the second control circuit board 120.

Among the differential signals dSCK+ and dSCK−, the differential signals dSI1+ to dSIn+ and dSI1− to dSIn−, the latch signal LAT, the change signal CH, and the voltages VHV and VDD, which are inputted into the drive circuit board 130, the latch signal LAT, the change signal CH, and the voltages VHV and VDD may be inputted into each of the drive circuits 132-1 to **132-*n* described above. The drive circuits 132-1 to 132-*n* may be driven by the voltage VDD used as power voltage and may generate the drive signals COMA1 to COMAn and COMB1 to COMBn respectively by amplifying the base drive signals DA1 to DAn and DB1 to DBn to a voltage that is based on the voltage VHV at the timing cued by the latch signal LAT and the change signal CH. In this case, the drive circuits 132-1 to 132-*n* may generate the reference voltage signals VBS1** to VBSn respectively by boosting the voltage VDD.

A differential signal de-conversion circuit 141, drive signal selection circuits 200-1 to **200-*n*, and a temperature abnormality detection circuit 142 are mounted on the discharge control circuit board 140**.

Each pair of differential signals dSI1+ to dSIn+ and dSI1− to dSIn− and the pair of differential signals dSCK+ and dSCK− are inputted into the differential signal de-conversion circuit 141. The differential signal de-conversion circuit 141 generates print data signals SI1 to SIn by performing de-conversion from the differential signals dSI1+ to dSIn+ and dSI1− to dSIn− into single-end signals, and outputs them to the drive signal selection circuits 200-1 to **200-*n* respectively. In addition, the differential signal de-conversion circuit 141 generates a clock signal SCK by performing de-conversion from the differential signals dSCK+ and dSCK− into a single-end signal, and outputs it to each of the drive signal selection circuits 200-1 to 200-*n***.

The print data signal SI1, the clock signal SCK, the latch signal LAT, the change signal CH, and the drive signals COMA1 and COMB1 are inputted into the drive signal selection circuit 200-1. The drive signal selection circuit 200-1 generates a drive signal VOUT1 by selecting or not selecting the drive signal COMA1, COMB1 at the timing cued by the latch signal LAT and the change signal CH, based on the print data signal SI1, and outputs it to a head 39-1. Similarly, the print data signal SIn, the clock signal SCK, the latch signal LAT, the change signal CH, and the drive signals COMAn and COMBn are inputted into the drive signal selection circuit **200-*n*. The drive signal selection circuit 200-*n* generates a drive signal VOUTn by selecting or not selecting the drive signal COMAn, COMBn at the timing cued by the latch signal LAT and the change signal CH, based on the print data signal Sin, and outputs it to a head 39-*n*. The configuration of the drive signal selection circuits 200-1 to 200-*n***, and the detailed operation thereof, will be described later.

The temperature abnormality detection circuit 142 detects the temperature of the discharge control circuit board 140 and the temperature of the drive signal selection circuits 200-1 to **200-*n* mounted on the discharge control circuit board 140. Then, the temperature abnormality detection circuit 142 generates a temperature abnormality detection signal XHOT, which indicates whether the temperature of the discharge control circuit board 140 and/or the temperature of the drive signal selection circuits 200-1 to 200-*n* are/is abnormal or not, and outputs it to the control circuit 121 mounted on the second control circuit board 120 via the drive circuit board 130. In addition, the temperature abnormality detection circuit 142 generates a temperature information signal TH, which indicates the detected temperature, and outputs it to the control circuit 121**.

The drive signal VOUT1 outputted from the drive signal selection circuit 200-1 and the reference voltage signal VBS1 are inputted into the head 39-1. Driven in accordance with a level difference between the drive signal VOUT1 and the reference voltage signal VBS1, the head 39-1 discharges ink an amount of which corresponds to the driving from its nozzles. Similarly, the drive signal VOUTn outputted from the drive signal selection circuit **200-*n* and the reference voltage signal VBSn are inputted into the head 39-*n*. Driven in accordance with a level difference between the drive signal VOUTn and the reference voltage signal VBSn, the head 39**-*n* discharges ink an amount of which corresponds to the driving from its nozzles. The structure of the head 39, and the detailed operation thereof, will be described later.

The head 39 configured to discharge ink as an example of liquid by being driven based on a drive signal COM is an example of a discharging head. The liquid discharging apparatus 1 includes the control circuit 111, 121 configured to control the driving of the head 39. The control circuit 111 is an example of a first control circuit. The control circuit 121 is an example of a second control circuit. The first control circuit board 110, on which the control circuit 111 is provided, is an example of a first control circuit board. The second control circuit board 120, on which the control circuit 121 is provided, is an example of a second control circuit board. The drive signal COMA, COMB is an example of a drive signal. At least any of the drive circuits 132-1 to 132-*n* configured to output the drive signal COMA, COMB is an example of a drive signal output circuit. The drive circuit board 130, on which the drive circuits 132-1 to 132-*n* are provided, is an example of a drive circuit board.

Each of the cables 151 to 158 providing electric connection for the power supply circuit board 100, the first control circuit board 110, the second control circuit board 120, the drive circuit board 130, the discharge control circuit board 140, the plurality of heads 39, the carriage motor 40, the driver portion 33, the transportation portion 45, and the operation portion 59 may include a plurality of cables. For each of the cables 151 to 158 providing the connection, depending on the form of a signal propagating therethrough, a flexible flat cable (FFC), a coaxial cable, an optical communication cable, or the like may be used.

3. Configuration and Operation of Drive Signal Selection Circuit

Next, the configuration and operation of the drive signal selection circuits 200-1 to 200-*n* will now be explained. The drive signal selection circuits 200-1 to 200-*n* have the same configuration as one another. Therefore, in the following explanation, the drive signal selection circuits 200-1 to 200-*n* will be collectively described as a drive signal selection circuit 200 without distinguishing them from one another. Moreover, the drive signal selection circuit 200 described below receives an input of a print data signal SI as a representative example of the print data signals SI1 to Sin, an input of a drive signal COMA as a representative example of the drive signals COMA1 to COMAn, and an input of a drive signal COMB as a representative example of the drive signals COMB1 to COMBn. Moreover, the drive signal selection circuit 200 described below outputs a drive signal VOUT to a head 39 by selecting or not selecting the drive signal COMA, COMB. Furthermore, the head 39 to which the drive signal VOUT is supplied receives an input of a reference voltage signal VBS as a representative example of the reference voltage signals VBS1 to VBSn.

Prior to giving a description of the configuration and operation of the drive signal selection circuit 200, an example of the waveforms of the drive signals COMA and COMB inputted into the drive signal selection circuit 200, and an example of the waveforms of the drive signal VOUT outputted from the drive signal selection circuit 200, are explained first below.

Figure 5:
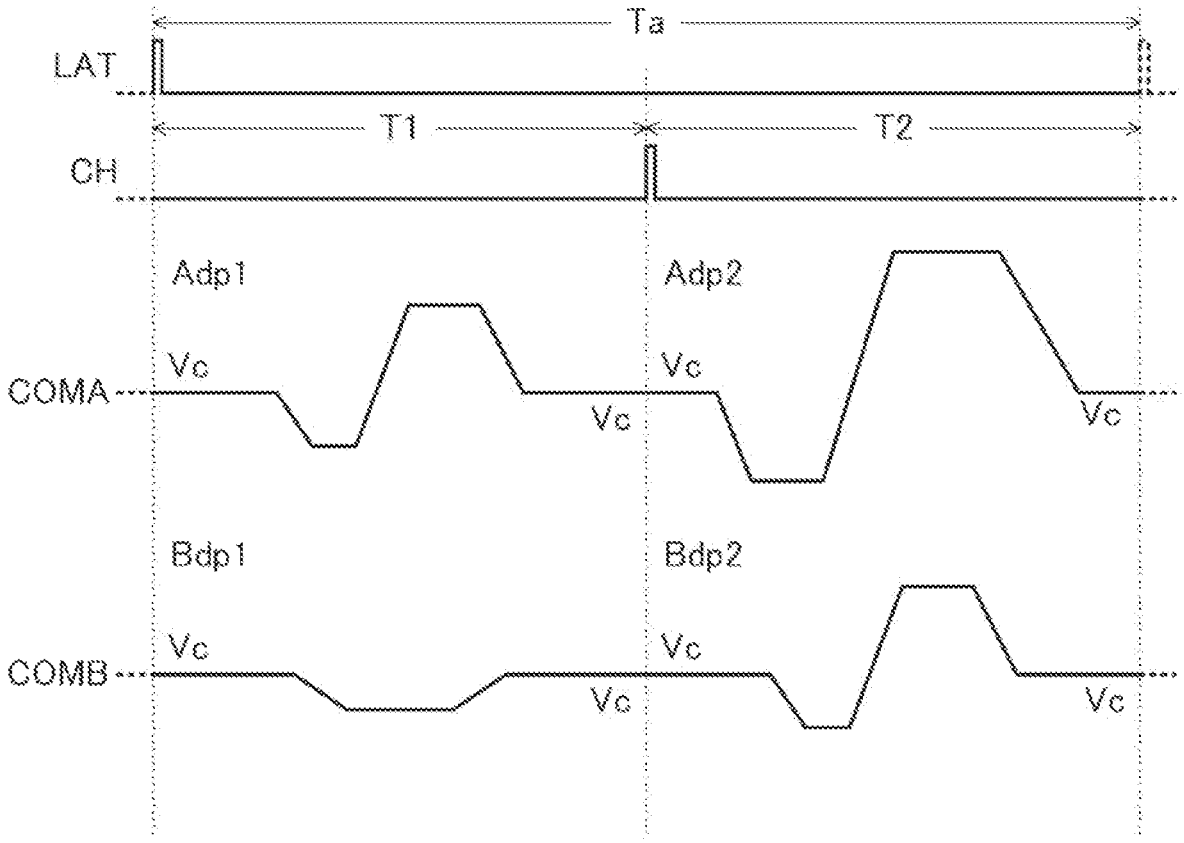
FIG. 5 is a diagram that illustrates an example of the waveforms of drive signals COMA and COMB.

FIG. 5 is a diagram that illustrates an example of the waveforms of the drive signals COMA and COMB. As illustrated in FIG. 5, the waveform of the drive signal COMA is a seamlessly-combined waveform made up of a trapezoidal waveform Adp1 during a period T1 from the rising of the latch signal LAT to the rising of the change signal CH and a trapezoidal waveform Adp2 during a period T2 from the rising of the change signal CH to the next rising of the latch signal LAT. When the trapezoidal waveform Adp1 is supplied to the head 39, a small amount of ink is discharged from the corresponding nozzle. When the trapezoidal waveform Adp2 is supplied to the head 39, a medium amount of ink, which is larger than the small amount, is discharged from the corresponding nozzle.

As illustrated in FIG. 5, the waveform of the drive signal COMB is a seamlessly-combined waveform made up of a trapezoidal waveform Bdp1 during the period T1 and a trapezoidal waveform Bdp2 during the period T2. When the trapezoidal waveform Bdp1 is supplied to the head 39, no ink is discharged from the corresponding nozzle. The trapezoidal waveform Bdp1 is a waveform for preventing the viscosity of ink from increasing, wherein the prevention is achieved by causing minute vibrations in ink near the orifice of the nozzle. When the trapezoidal waveform Bdp2 is supplied to the head 39, a small amount of ink is discharged from the corresponding nozzle, similarly to the case of supply of the trapezoidal waveform Adp1.

The voltage at the timing of the start and end of each of the trapezoidal waveforms Adp1, Adp2, Bdp1, and Bdp2 is a voltage Vc, which is common to them. That is, each of the trapezoidal waveforms Adp1, Adp2, Bdp1, and Bdp2 starts at the voltage Vc and ends at the voltage Vc. A cycle Ta, which is made up of the periods T1 and T2, corresponds to a print cycle of forming a dot on the medium 22.

In FIG. 5, the trapezoidal waveform Adp1 and the trapezoidal waveform Bdp2 are depicted to be the same as each other. However, the trapezoidal waveform Adp1 and the trapezoidal waveform Bdp2 may be different from each other. Although it is described that a small amount of ink is discharged from the nozzles both in a case where the trapezoidal waveform Adp1 is supplied to the head 39 and a case where the trapezoidal waveform Bdp2 is supplied to the head 39, the scope of the present disclosure is not limited to this example. That is, the waveforms of the drive signals COMA and COMB are not limited to the example illustrated in FIG. 5. Depending on the movement speed of the carriage 38 on which the head 39 is mounted, the property of ink that is discharged, the material of the medium 22, and/or other factors, signals based on combinations of various waveforms may be used. The waveforms of the drive signals COMA1 to COMAn and COMB1 to COMBn corresponding respectively to the heads 39-1 to 39-*n* may be different from one another.

Figure 6:
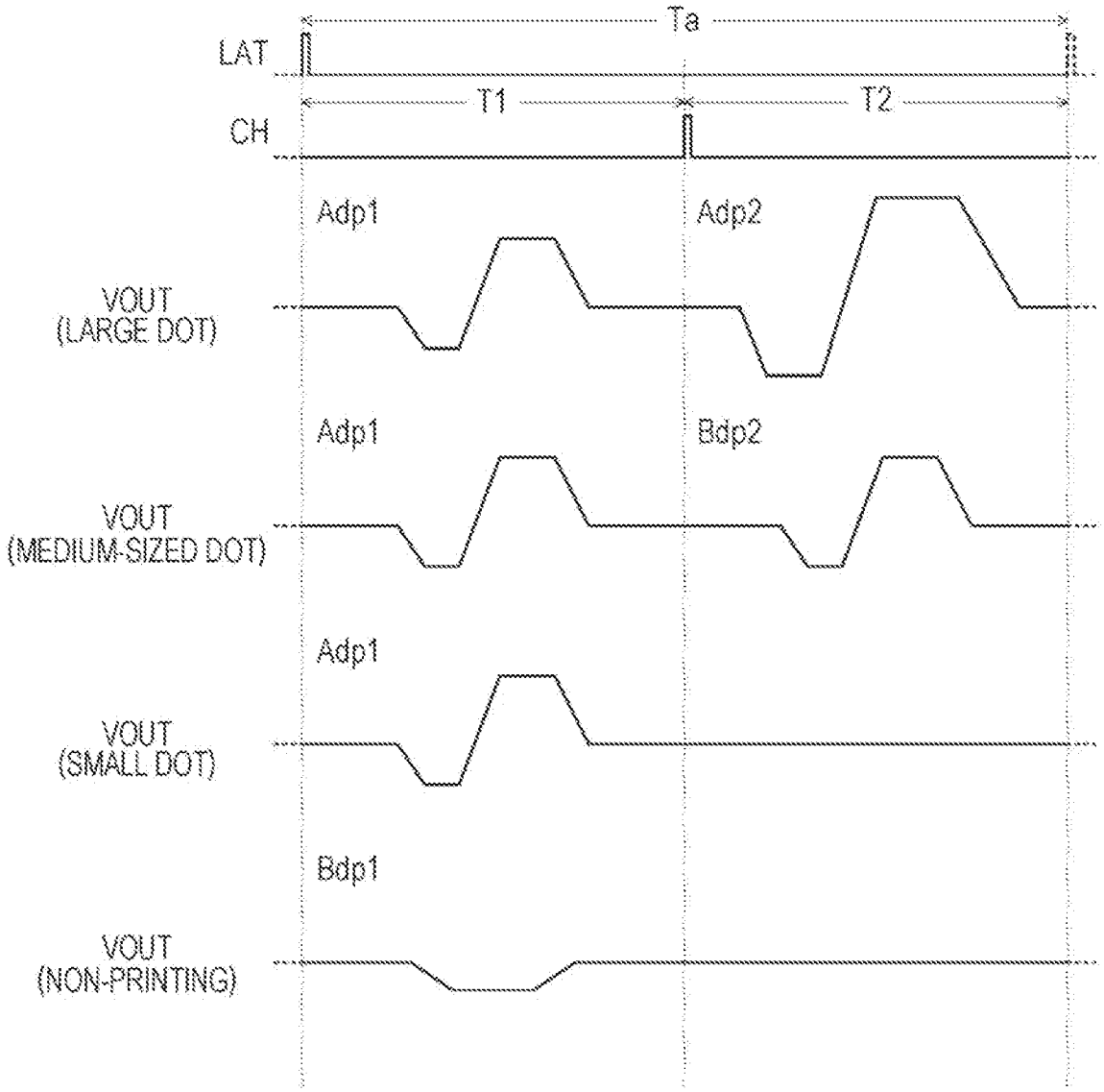
FIG. 6 is a diagram that illustrates an example of the waveforms of a drive signal VOUT.

FIG. 6 is a diagram that illustrates an example of the waveforms of the drive signal VOUT for cases where the size of the dot to be formed on the medium 22 is "large", "medium", "small" and a case of "non-printing", respectively.

As illustrated in FIG. 6, the waveform of the drive signal VOUT for a case where a "large dot" is to be formed on the medium 22 is a seamlessly-combined waveform made up of the trapezoidal waveform Adp1 during the period T1 and the trapezoidal waveform Adp2 during the period T2. When the drive signal VOUT having this waveform is supplied to the head 39, a small amount of ink and a medium amount of ink are discharged from the corresponding nozzle within the cycle Ta. Therefore, due to the merging of the respective ink droplets on the medium 22 into one, a large dot is formed thereon.

The waveform of the drive signal VOUT for a case where a "medium-sized dot" is to be formed on the medium 22 is a seamlessly-combined waveform made up of the trapezoidal waveform Adp1 during the period T1 and the trapezoidal waveform Bdp2 during the period T2. When the drive signal VOUT having this waveform is supplied to the head 39, a small amount of ink is discharged twice from the corresponding nozzle within the cycle Ta. Therefore, due to the merging of the respective ink droplets on the medium 22 into one, a medium-sized dot is formed thereon.

The waveform of the drive signal VOUT for a case where a "small dot" is to be formed on the medium 22 is a seamlessly-combined waveform made up of the trapezoidal waveform Adp1 during the period T1 and a flat waveform that is constant at the voltage Vc during the period T2. When the drive signal VOUT having this waveform is supplied to the head 39, a small amount of ink is discharged from the corresponding nozzle within the cycle Ta. Therefore, due to the landing of this ink droplet onto the medium 22, a small dot is formed thereon.

The waveform of the drive signal VOUT corresponding to "non-printing", in which no dot is to be formed on the medium 22, is a seamlessly-combined waveform made up of the trapezoidal waveform Bdp1 during the period T1 and a flat waveform that is constant at the voltage Vc during the period T2. When the drive signal VOUT having this waveform is supplied to the head 39, no ink is discharged within the cycle Ta, except that minute vibrations occur in ink near the orifice of the corresponding nozzle. Since no ink droplet is ejected onto the medium 22, no dot is formed thereon.

The flat waveform that is constant at the voltage Vc is a waveform of retention of the immediately-preceding voltage Vc when none of the trapezoidal waveforms Adp1, Adp2, Bdp1, and Bdp2 is selected for the drive signal VOUT. Therefore, it can be said that the voltage Vc is supplied as the drive signal VOUT to the head 39 when none of the trapezoidal waveforms Adp1, Adp2, Bdp1, and Bdp2 is selected for the drive signal VOUT.

Figure 7:
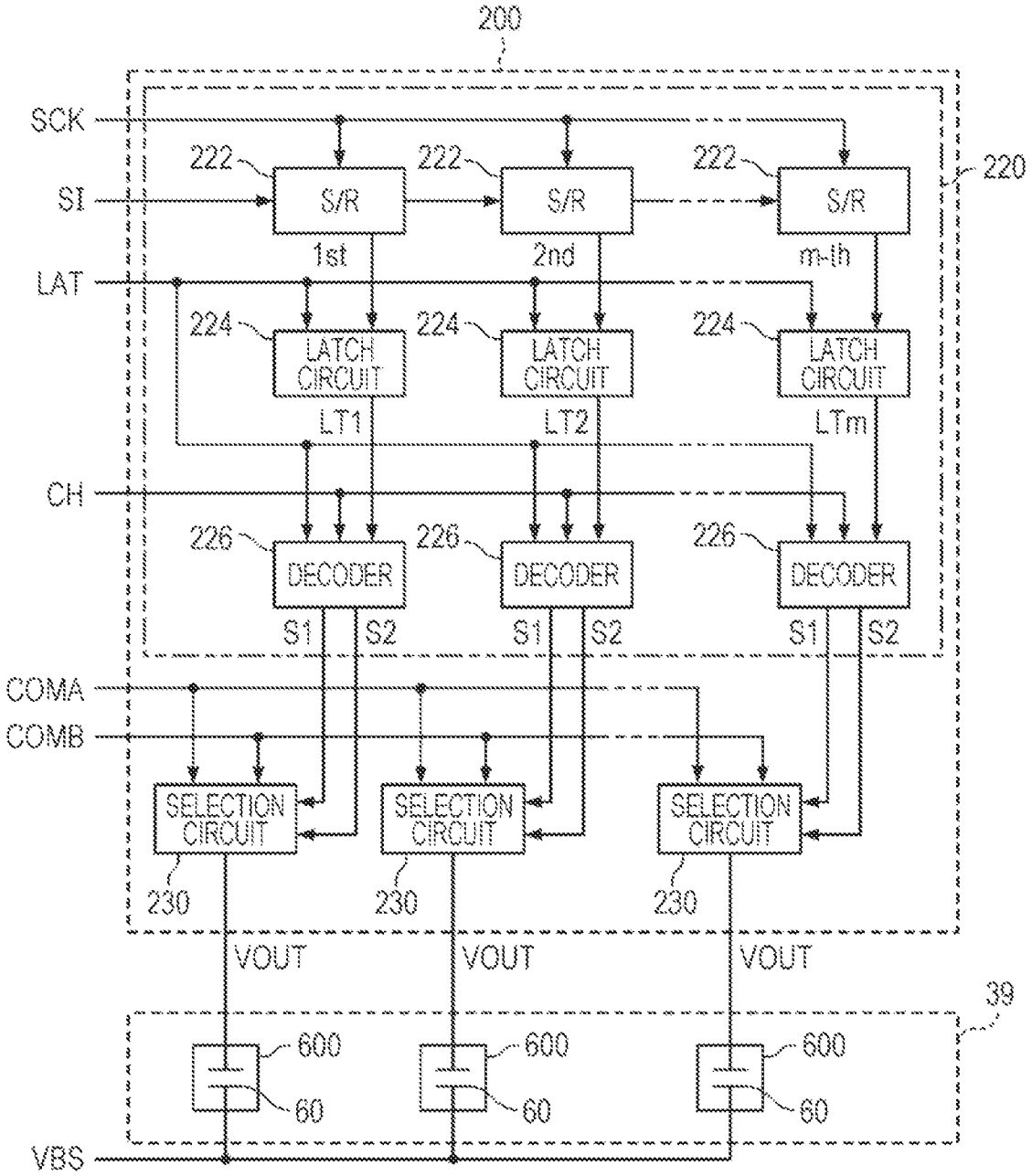
FIG. 7 is a diagram that illustrates a configuration of a drive signal selection circuit.

The drive signal selection circuit 200 generates the drive signal VOUT by selecting or not selecting the waveform of the drive signal COMA and the waveform of the drive signal COMB, and outputs it to the head 39. FIG. 7 is a diagram that illustrates a configuration of the drive signal selection circuit 200. As illustrated in FIG. 7, the drive signal selection circuit 200 includes a selection control circuit 220 and a plurality of selection circuits 230. The head 39 to which the drive signal VOUT outputted from the drive signal selection circuit 200 is supplied includes a plurality m of dischargers 600.

The print data signal SI, the latch signal LAT, the change signal CH, and the clock signal SCK are inputted into the selection control circuit 220. Groups each consisting of a shift register (S/R) 222, a latch circuit 224, and a decoder 226 are provided in the selection control circuit 220, wherein the groups correspond respectively to the plurality m of dischargers 600 of the head 39. Namely, the drive signal selection circuit 200 includes the groups each consisting of the shift register 222, the latch circuit 224, and the decoder 226, wherein the number of the groups is equal to the number of the plurality, m, of dischargers 600 of the head 39.

The print data signal SI is a signal synchronized with the clock signal SCK. The print data signal SI is a signal of 2 m bits in total, containing pieces of 2-bit print data [SIH, SIL] for selecting any one of "large dot", "medium-sized dot", "small dot", and "non-printing" for the plurality m of dischargers 600 respectively. The pieces of 2-bit print data [SIH, SIL] contained in the inputted print data signal SI are stored into the shift registers 222 corresponding to the plurality m of dischargers 600 respectively. Specifically, in the selection control circuit 220, m stages of shift registers 222 corresponding to the plurality m of dischargers 600 are connected in a cascade arrangement, and the print data signal SI inputted serially is sequentially transferred to the next stage in accordance with the clock signal SCK. In FIG. 5, for the purpose of distinguishing the shift registers 222 from one another, they are sequentially labeled with the first stage, the second stage, . . . , the m-th stage from upstream in the sequential flow of the input of the print data signal SI.

At the rising of the latch signal LAT, each of the plurality m of latch circuits 224 latches the 2-bit print data [SIH, SIL] stored by the corresponding one of the plurality m of shift registers 222.

Figures 8, 9:
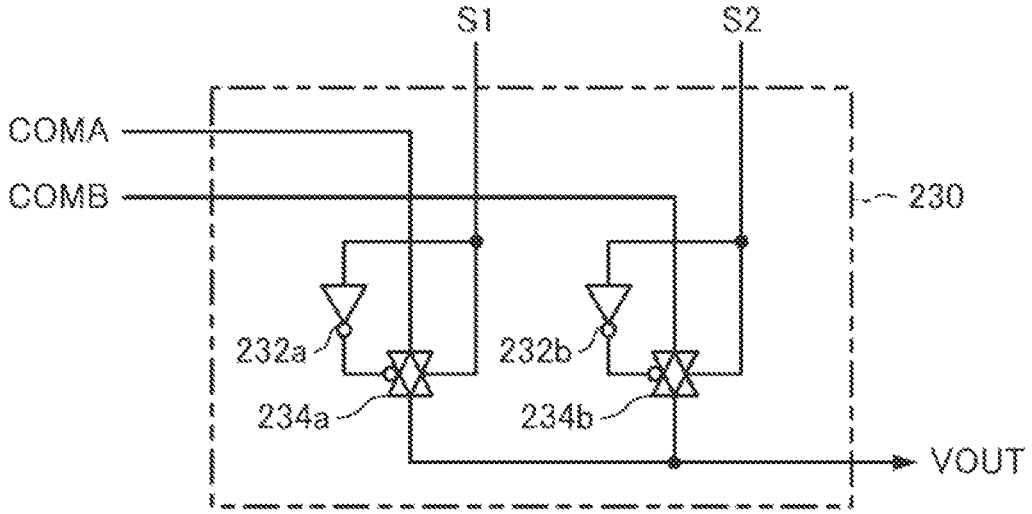
FIG. 8 is a table that shows the content of decoding by a decoder.
FIG. 9 is a diagram that illustrates a configuration of a selection circuit.

FIG. 8 is a table that shows the content of decoding by the decoder 226. The decoder 226 outputs selection signals S1 and S2 in accordance with the latched 2-bit print data [SIH, SIL]. For example, if the 2-bit print data [SIH, SIL] is [1, 0], the decoder 226 outputs the logical level of the selection signal S1 as the H level in the period T1 and as the L level in the period T2 to the selection circuit 230, and outputs the logical level of the selection signal S2 as the L level in the period T1 and as the H level in the period T2 to the selection circuit 230.

Each of the selection circuits 230 is provided for the corresponding one of dischargers 600. That is, the number of the plurality of selection circuits 230 of the drive signal selection circuit 200 is equal to the number of the plurality, m, of dischargers 600 corresponding thereto. FIG. 9 is a diagram that illustrates a configuration of the selection circuit 230 corresponding to one of the dischargers 600. As illustrated in FIG. 9, the selection circuit 230 includes inverters 232*a* and 232*b*, which are NOT circuits, and transfer gates 234*a* and 234*b*.

The selection signal S1 is inputted into the positive control terminal without a circle mark of the transfer gate 234*a*, and is, on the other side, inputted into the negative control terminal with a circle mark of the transfer gate 234*a* through logical inversion by the inverter 232*a*. The drive signal COMA is supplied to the input terminal of the transfer gate 234*a*. The selection signal S2 is inputted into the positive control terminal without a circle mark of the transfer gate 234*b*, and is, on the other side, inputted into the negative control terminal with a circle mark of the transfer gate 234*b* through logical inversion by the inverter 232*b*. The drive signal COMB is supplied to the input terminal of the transfer gate 234*b*. The output terminal of the transfer gate 234*a* and the output terminal of the transfer gate 234*b* are connected in common, and the drive signal VOUT is outputted.

Specifically, the transfer gate 234*a* provides an electrical continuity between the input terminal and the output terminal if the selection signal S1 is in the H level, and provides no electrical continuity between the input terminal and the output terminal if the selection signal S1 is in the L level. The transfer gate 234*b* provides an electrical continuity between the input terminal and the output terminal if the selection signal S2 is in the H level, and provides no electrical continuity between the input terminal and the output terminal if the selection signal S2 is in the L level. As explained above, based on the selection signal S1 and the selection signal S2, the selection circuit 230 performs selection regarding the waveform of the drive signal COMA and the waveform of the drive signal COMB, and outputs the drive signal VOUT.

Figure 10:
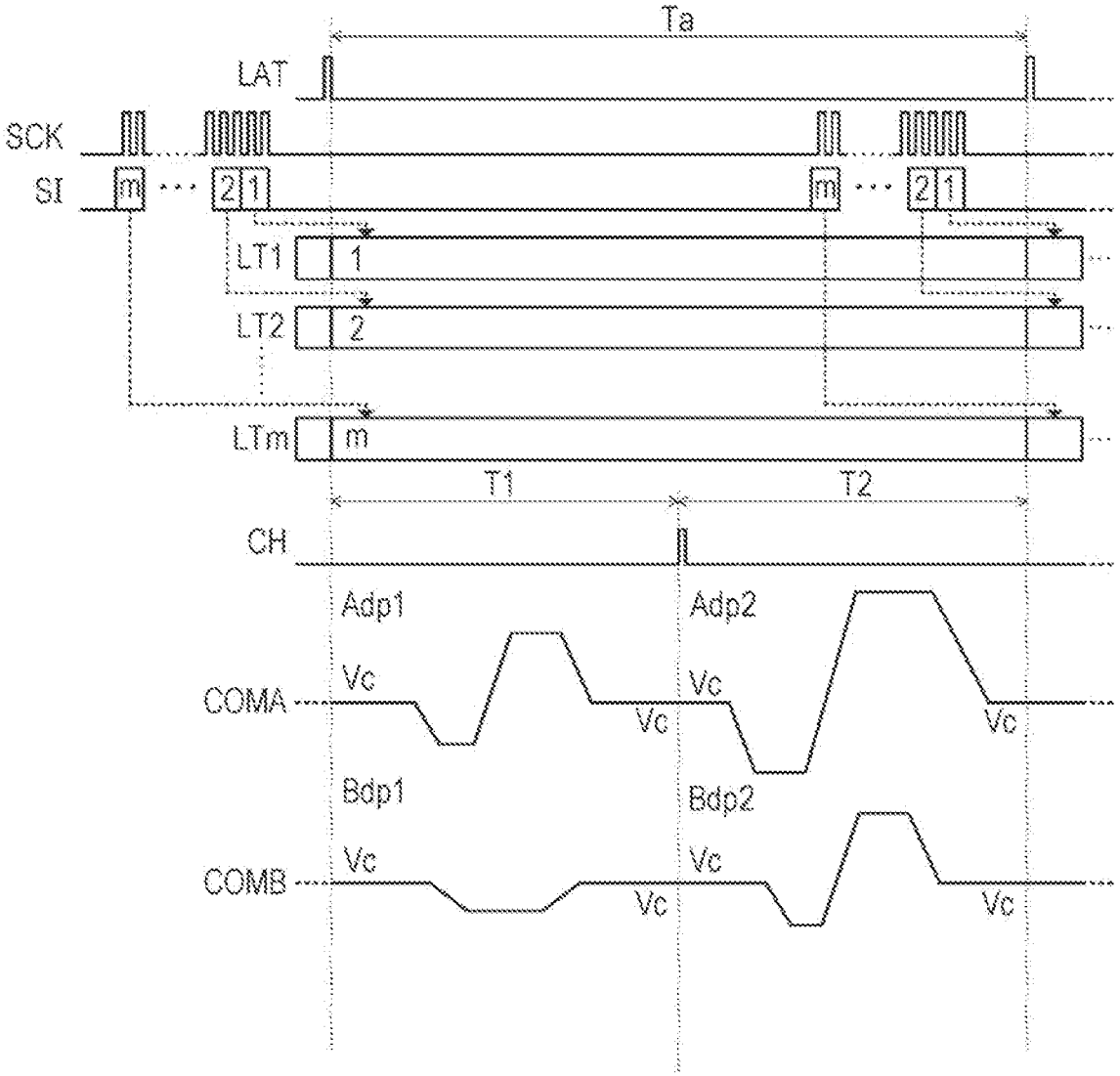
FIG. 10 is a diagram for explaining the operation of the drive signal selection circuit.

With reference to FIG. 10, the operation of the drive signal selection circuit 200 will now be explained. FIG. 10 is a diagram for explaining the operation of the drive signal selection circuit 200. The print data signal SI is inputted serially in sync with the clock signal SCK and is sequentially transferred through the shift registers 222 corresponding to the dischargers 600. Upon the stopping of the input of the clock signal SCK, the pieces of 2-bit print data [SIH, SIL] corresponding respectively to the dischargers 600 are stored into the shift registers 222. The pieces of 2-bit print data [SIH, SIL] contained in the print data signal SI are inputted in the order corresponding to the dischargers 600 for the m-th stage, . . . , the second stage, the first stage of the shift registers 222.

The latch circuits 224 latch the pieces of 2-bit print data [SIH, SIL] stored in the shift registers 222 all at once when the latch signal LAT rises. In FIG. 10, LT1, LT2, . . . , LTm denote the pieces of 2-bit print data [SIH, SIL] latched by the latch circuits 224 corresponding to the first stage, the second stage, . . . , the m-th stage of the shift registers 222.

The decoder 226 outputs the logical levels of the selection signals S1 and S2 in accordance with the content of the table in FIG. 8 in the periods T1 and T2, depending on the dot size specified by the latched 2-bit print data [SIH, SIL].

Specifically, if the print data [SIH, SIL] is [1, 1], the decoder 226 outputs the logical level of the selection signal S1 as the H level in the period T1 and as the H level in the period T2, and outputs the logical level of the selection signal S2 as the L level in the period T1 and as the L level in the period T2. In this case, the selection circuit 230 selects the trapezoidal waveform Adp1 in the period T1 and the trapezoidal waveform Adp2 in the period T2. As a result, the drive signal VOUT corresponding to a "large dot" shown in FIG. 6 is generated.

If the print data [SIH, SIL] is [1, 0], the decoder 226 outputs the logical level of the selection signal S1 as the H level in the period T1 and as the L level in the period T2, and outputs the logical level of the selection signal S2 as the L level in the period T1 and as the H level in the period T2. In this case, the selection circuit 230 selects the trapezoidal waveform Adp1 in the period T1 and the trapezoidal waveform Bdp2 in the period T2. As a result, the drive signal VOUT corresponding to a "medium-sized dot" shown in FIG. 6 is generated.

If the print data [SIH, SIL] is [0, 1], the decoder 226 outputs the logical level of the selection signal S1 as the H level in the period T1 and as the L level in the period T2, and outputs the logical level of the selection signal S2 as the L level in the period T1 and as the L level in the period T2. In this case, the selection circuit 230 selects the trapezoidal waveform Adp1 in the period T1 and neither of the trapezoidal waveform Adp2 and the trapezoidal waveform Bdp2 in the period T2. As a result, the drive signal VOUT corresponding to a "small dot" shown in FIG. 6 is generated.

If the print data [SIH, SIL] is [0, 0], the decoder 226 outputs the logical level of the selection signal S1 as the L level in the period T1 and as the L level in the period T2, and outputs the logical level of the selection signal S2 as the H level in the period T1 and as the L level in the period T2. In this case, the selection circuit 230 selects the trapezoidal waveform Bdp1 in the period T1 and neither of the trapezoidal waveform Adp2 and the trapezoidal waveform Bdp2 in the period T2. As a result, the drive signal VOUT corresponding to "non-printing" shown in FIG. 6 is generated.

As explained above, based on the print data signal SI, the latch signal LAT, the change signal CH, and the clock signal SCK, the drive signal selection circuit 200 performs selection regarding the waveform of the drive signal COMA and the waveform of the drive signal COMB, and outputs the selection result as the drive signal VOUT. That is, in a broad sense, the drive signal VOUT, which is generated by performing selection regarding the waveform of the drive signal COMA and the waveform of the drive signal COMB, is also outputted from the drive circuit 132-1 to **132-*n*. That is, in the present embodiment, the drive signal VOUT is also an example of a drive signal for driving the head 39**.

4. Structure of Discharging Head

Figure 11:
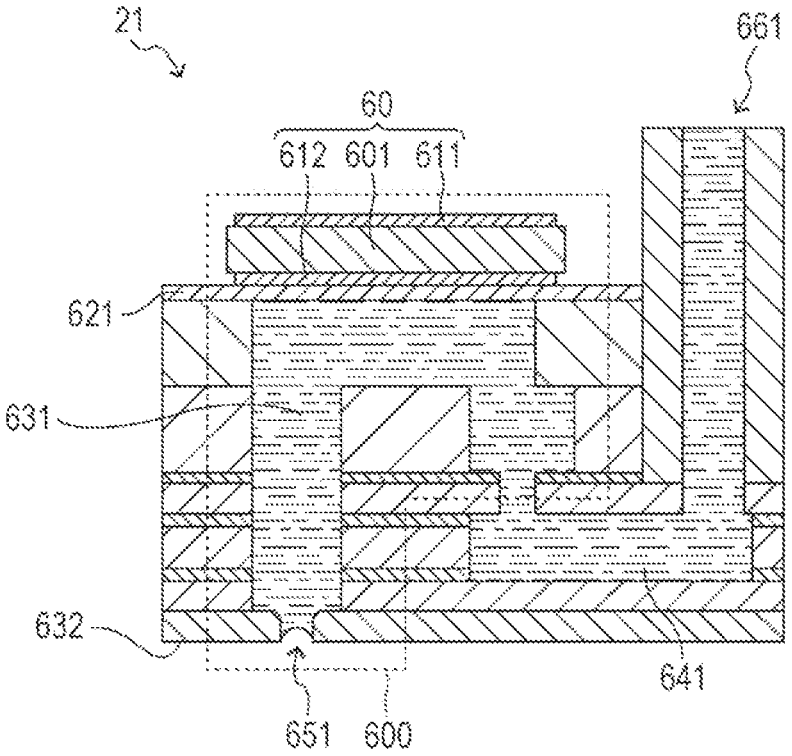
FIG. 11 is a diagram that illustrates a structure of a discharger.

Next, the structure of one of the plurality m of dischargers 600 included in the head 39 will now be explained. FIG. 11 is a diagram that illustrates a structure of the discharger 600. As illustrated in FIG. 11, the discharger 600 includes a piezoelectric element 60, a vibrating plate 621, a cavity 631, and a nozzle 651. The vibrating plate 621 moves when the piezoelectric element 60 provided on its upper surface in FIG. 9 is driven. The vibrating plate 621 behaves as a diaphragm that increases/decreases the internal capacity of the cavity 631. The inside of the cavity 631 is filled with ink. The cavity 631 behaves as a pressure compartment, the internal capacity of which changes due to deformative movement of the vibrating plate 621 caused by the driving of the piezoelectric element 60. The nozzle 651 is an orifice portion that is formed though a nozzle plate 632 and is in communication with the cavity 631. Due to a change in the internal capacity of the cavity 631, ink contained inside the cavity 631 is discharged from the nozzle 651. Ink supplied through an ink supply port 661 is supplied to the cavity 631 via a reservoir 641.

The piezoelectric element 60 has a structure of sandwiching a piezoelectric body 601 between a pair of electrodes 611 and 612. In accordance with a potential difference between the electrodes 611 and 612, the piezoelectric body 601 in this structure at the center portion of the electrodes 611 and 612 and the vibrating plate 621 deforms in the vertical direction in FIG. 11 with respect to both ends. Specifically, the drive signal VOUT is supplied to the electrode 611, which is one terminal of the piezoelectric element 60, and the reference voltage signal VBS is supplied to the electrode 612, which is the opposite terminal of the piezoelectric element 60. The center portion of the piezoelectric element 60 deforms upward when the voltage of the drive signal VOUT decreases. The center portion of the piezoelectric element 60 deforms downward when the voltage of the drive signal VOUT increases. The vibrating plate 621 moves upward due to the upward deformation of the piezoelectric element 60, thereby increasing the internal capacity of the cavity 631. Therefore, ink is sucked in from the reservoir 641. The vibrating plate 621 moves downward due to the downward deformation of the piezoelectric element 60, thereby decreasing the internal capacity of the cavity 631. Therefore, ink whose amount corresponds to the degree of the decrease in the internal capacity of the cavity 631 is discharged from the nozzle 651.

As explained above, the discharger 600 includes the piezoelectric element 60 and discharges ink onto the medium 22 by the driven operation of the piezoelectric element 60. The structure of the piezoelectric element 60 is not limited to the illustrated structure. Any other structure may be adopted as long as it is possible to discharge ink by deformative action of the piezoelectric element 60. The vibration mode of the piezoelectric element 60 is not limited to flexural vibration. Longitudinal vibration may be used instead.

5. Layout of Circuit Boards Provided in Liquid Discharging Apparatus

As explained above, the liquid discharging apparatus 1 according to the present embodiment includes the power supply circuit board 100, the first control circuit board 110, the second control circuit board 120, the drive circuit board 130, the discharge control circuit board 140, and the plurality of heads 39. The power supply circuit board 100 and the first control circuit board 110 are electrically coupled to each other via the cable 151. The first control circuit board 110 and the second control circuit board 120 are electrically coupled to each other via the cable 152. The second control circuit board 120 and the drive circuit board 130 are electrically coupled to each other via the cable 154. The drive circuit board 130 and the discharge control circuit board 140 are electrically coupled to each other via the cable 158. The drive signal VOUT outputted from the discharge control circuit board 140 is inputted into the corresponding head 39. By this means, ink is discharged from the head 39. Since the ink droplets ejected land onto the medium 22, an image is formed on the medium 22 as demanded.

Figure 12:
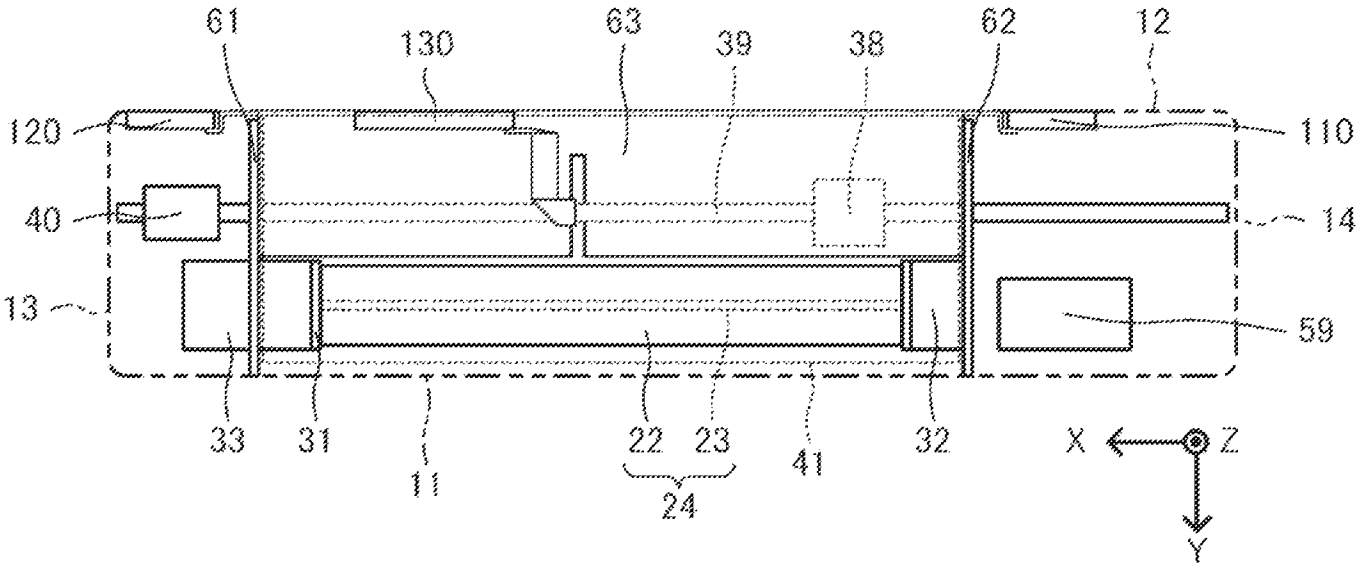
FIG. 12 is a diagram for explaining the layout of circuit boards when the liquid discharging apparatus is viewed from the +Z side.
Figure 13:
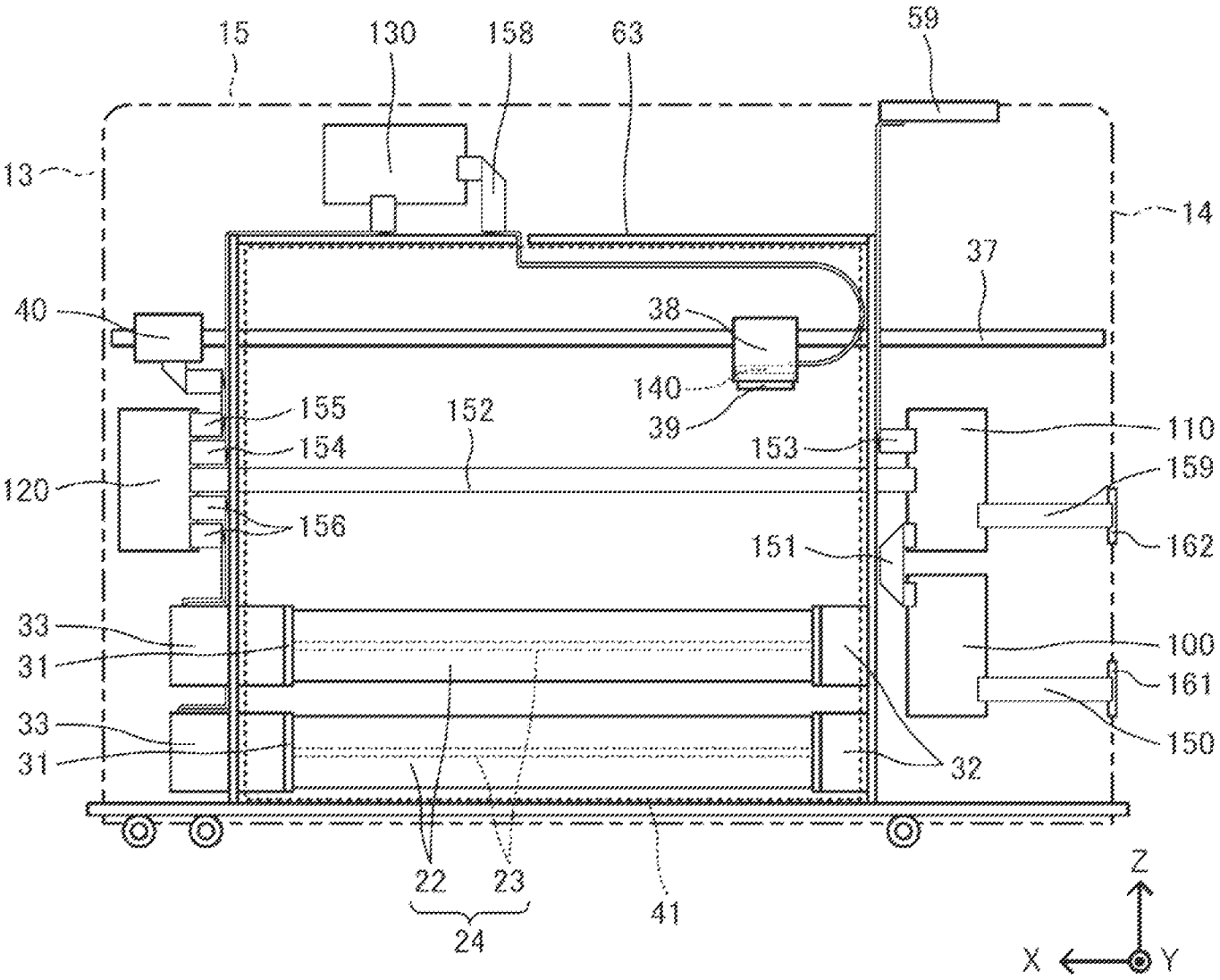
FIG. 13 is a diagram for explaining the layout of circuit boards when the liquid discharging apparatus is viewed from the +Y side.

Next, with reference to FIGS. 12 and 13, a specific example of the layout of the power supply circuit board 100, the first control circuit board 110, the second control circuit board 120, the drive circuit board 130, and the discharge control circuit board 140 inside the housing 10 of the liquid discharging apparatus 1 will now be described. FIG. 12 is a diagram for explaining the layout of circuit boards when the liquid discharging apparatus 1 is viewed from the +Z side. FIG. 13 is a diagram for explaining the layout of circuit boards when the liquid discharging apparatus 1 is viewed from the +Y side.

The medium 22 is transported in a region that is between the first side frame 61 and the second side frame 62 in FIG. 12 and that is enclosed by the first side frame 61, the second side frame 62, and a top frame 63 in FIG. 13, wherein the top frame 63 is connected to both of the first side frame 61 and the second side frame 62 and is located on the +Z side with respect to the first side frame 61 and the second side frame 62. That is, the transportation path forming portion 46, the intermediate roller 47, and the transportation roller 48 of the transportation portion 45 configured to transport the medium 22 are provided in the region enclosed by the first side frame 61, the second side frame 62, and the top frame 63. The region enclosed by the first side frame 61, the second side frame 62, and the top frame 63 may be referred to as a medium transportation region 41.

As illustrated in FIGS. 12 and 13, the power supply circuit board 100 is located on the −X side with respect to the medium transportation region 41 and is fixed to the rear wall 12. The power supply circuit board 100 is electrically coupled to a terminal 161 via a cable 150 and is electrically coupled to the first control circuit board 110 via the cable 151.

The terminal 161 is located on the −X side with respect to the power supply circuit board 100 and is fixed to the second sidewall 14. The terminal 161 is electrically coupled to the power supply circuit board 100 via the cable 150. A voltage VAC is inputted to the terminal 161 from a commercial alternating-current power supply provided outside the liquid discharging apparatus 1. For example, an inlet that is connectable to a cable through which the voltage VAC propagates is used as the terminal 161. In the liquid discharging apparatus 1, a socket plug that is integrally made up of a cable through which the voltage VAC propagates and the terminal 161 may be used.

The first control circuit board 110 is located on the −X side with respect to the medium transportation region 41 and on the +Z side with respect to the power supply circuit board 100, and is fixed to the rear wall 12. The first control circuit board 110 is electrically coupled to the power supply circuit board 100 via the cable 151, is electrically coupled to the second control circuit board 120 via the cable 152, is electrically coupled to the operation portion 59 via the cable 153, and is electrically coupled to a terminal 162 via a cable 159.

The operation portion 59 is located on the −X side with respect to the medium transportation region 41 and on the +Z side with respect to the first control circuit board 110, and is fixed to the top wall 15. The operation portion 59 is electrically coupled to the first control circuit board 110 via the cable 153.

The terminal 162 is located on the −X side with respect to the first control circuit board 110 and on the +Z side with respect to the terminal 161, and is fixed to the second sidewall 14. The terminal 162 is electrically coupled to the first control circuit board 110 via the cable 159. An image signal IMG is inputted to the terminal 162 from a host computer provided outside the liquid discharging apparatus 1. For example, a USB terminal to be connected to the host computer via a USB cable such that communication can be performed therebetween is used as the terminal 161. Any terminal to which a cable for communication with the host computer is connectable can be used as the terminal 161. For example, the terminal 161 may be a printer port. The liquid discharging apparatus 1 may be connected to the host computer such that communication can be performed therebetween wirelessly. In such a case, a receiver antenna for receiving a signal based on the wireless communication corresponds to the terminal 162.

The second control circuit board 120 is located on the +X side with respect to the medium transportation region 41 and is fixed to the rear wall 12. The second control circuit board 120 is electrically coupled to the first control circuit board 110 via the cable 152, is electrically coupled to the drive circuit board 130 via the cable 154, is electrically coupled to the carriage motor 40 via the cable 155, and is electrically coupled to the driver portion 33 via the cable 156.

The driver portion 33 is located on the +X side with respect to the medium transportation region 41 and on the −Z side with respect to the second control circuit board 120, and is fixed to the first side frame 61. The driver portion 33 is electrically coupled to the second control circuit board 120 via the cable 156.

The carriage motor 40 is located on the +X side with respect to the medium transportation region 41 and on the +Z side with respect to the second control circuit board 120, and is fixed to the guide shaft 37. The carriage motor 40 is electrically coupled to the second control circuit board 120 via the cable 155.

The drive circuit board 130 is located on the +Z side with respect to the medium transportation region 41 and is fixed to the rear wall 12. In other words, the drive circuit board 130 and the medium transportation region 41 partially overlap with each other when viewed along the Z direction. The drive circuit board 130 is electrically coupled to the second control circuit board 120 via the cable 154 and is electrically coupled to the discharge control circuit board 140 mounted in the carriage 38 via the cable 158.

As explained above, in the present embodiment, the first control circuit board 110 and the second control circuit board 120 are electrically coupled to each other via the cable 152. The first control circuit board 110 is located on the −X side with respect to the medium transportation region 41 and is located on the side where there is the second sidewall 14 of the housing 10. In addition, on the −X side with respect to the medium transportation region 41, the operation portion 59, via which a user inputs information so as to cause the liquid discharging apparatus 1 to discharge ink onto the medium 22, and the terminal 162, to which the image signal IMG representing data of an image to be formed on the medium 22 is inputted, are located in the liquid discharging apparatus 1.

The operation portion 59 inputs the operation information signal CS via the cable 153 into the control circuit 111 mounted on the first control circuit board 110. The terminal 162 inputs the image signal IMG via the cable 159 into the control circuit 111 mounted on the first control circuit board 110. That is, in the liquid discharging apparatus 1, the operation portion 59 operable for discharging ink onto the medium 22 is electrically coupled to the control circuit 111 mounted on the first control circuit board 110, and the terminal 162 operable for discharging ink onto the medium 22 is electrically coupled to the control circuit 111 mounted on the first control circuit board 110. The operation portion 59, the terminal 162, and the first control circuit board 110 are located on the −X side with respect to the medium transportation region 41.

The second control circuit board 120 is located on the +X side with respect to the medium transportation region 41 and is located on the side where there is the first sidewall 13 of the housing 10. In addition, on the +X side with respect to the medium transportation region 41, the carriage motor 40, which controls the movement of the carriage 38 on which the plurality of heads 39 is mounted, and the driver portion 33, which causes the first holder portion 31 and the second holder portion 32 to rotate for controlling the transportation of the medium 22, are located in the liquid discharging apparatus 1. The carriage control signal CMC is inputted into the carriage motor 40 via the cable 155. The drive control signal DC1 is inputted into the driver portion 33 via the cable 156. That is, the carriage motor 40 operable for discharging ink onto the medium 22 is electrically coupled to the control circuit 121 mounted on the second control circuit board 120, and the driver portion 33 operable for discharging ink onto the medium 22 is electrically coupled to the control circuit 121 mounted on the second control circuit board 120. The carriage motor 40, the driver portion 33, and the second control circuit board 120 are located on the +X side with respect to the medium transportation region 41.

As explained above, the liquid discharging apparatus 1 includes the housing 10 that houses the first control circuit board 110, the second control circuit board 120, the operation portion 59, the terminal 162, the carriage motor 40, and the driver portion 33. Inside the housing 10, the first control circuit board 110 and the second control circuit board 120 are located such that a minimum distance between the first control circuit board 110 and the second sidewall 14 is shorter than a minimum distance between the first control circuit board 110 and the first sidewall 13 and such that a minimum distance between the second control circuit board 120 and the first sidewall 13 is shorter than a minimum distance between the second control circuit board 120 and the second sidewall 14.

Moreover, in the liquid discharging apparatus 1, the operation portion 59 and the terminal 162, which are electrically coupled to the first control circuit board 110, are provided closer to the first control circuit board 110 than the second control circuit board 120, and the carriage motor 40 and the driver portion 33, which are electrically coupled to the second control circuit board 120, are provided closer to the second control circuit board 120 than the first control circuit board 110. In other words, the operation portion 59, the terminal 162, the carriage motor 40, and the driver portion 33 are located such that a minimum distance from the first control circuit board 110 to the operation portion 59 and to the terminal 162 is shorter than a minimum distance from the first control circuit board 110 to the carriage motor 40 and to the driver portion 33 and such that a minimum distance from the second control circuit board 120 to the carriage motor 40 and to the driver portion 33 is shorter than a minimum distance from the second control circuit board 120 to the operation portion 59 and to the terminal 162.

This structure makes it possible to shorten the wire-routing length of the cable 153 for electrically coupling the first control circuit board 110 to the operation portion 59 operable for discharging ink onto the medium 22 and the wire-routing length of the cable 159 for electrically coupling the first control circuit board 110 to the terminal 162 operable for discharging ink onto the medium 22. In addition, this structure makes it possible to shorten the wire-routing length of the cable 155 for electrically coupling the second control circuit board 120 to the carriage motor 40 operable for discharging ink onto the medium 22 and the wire-routing length of the cable 156 for electrically coupling the second control circuit board 120 to the driver portion 33 operable for discharging ink onto the medium 22. Therefore, the risk of contamination of signals propagating via the cables 153, 159, 155, and 156 respectively with noise is reduced.

In the liquid discharging apparatus 1 according to the present embodiment, the drive circuit board 130, on which the drive circuits 132-1 to **132-*n* configured to output the drive signals COMA1 to COMAn and COMB1 to COMBn for driving the respective heads 39 and the reference voltage signals VBS1 to VBSn respectively are provided, is provided on the +Z side with respect to the medium transportation region 41 and closer to the second control circuit board 120 than the first control circuit board 110. The drive circuit board 130 is electrically coupled to the second control circuit board 120 via the cable 154. In this example, the drive circuit board 130 is located such that a minimum distance from the first control circuit board 110 to the operation portion 59 and to the terminal 162 is shorter than a minimum distance from the first control circuit board 110 to the drive circuit board 130 and such that a minimum distance from the second control circuit board 120 to the drive circuit board 130 is shorter than a minimum distance from the second control circuit board 120 to the operation portion 59 and to the terminal 162**.

This structure makes it possible to shorten the wire-routing length of the cable 154 for electrically coupling the second control circuit board 120 to each of the drive circuits 132-1 to **132-*n* mounted on the drive circuit board 130 operable for discharging ink onto the medium 22. Therefore, the risk of contamination of a signal propagating via the cable 154** with noise is reduced.

Among the operation portion 59, the terminal 162, the carriage motor 40, the driver portion 33, and the drive circuit board 130, which are operable for discharging ink onto the medium 22, at least one of the operation portion 59 and the terminal 162 is an example of a first component, and at least one of the carriage motor 40, the driver portion 33, and the drive circuit board 130 is an example of a second component. That is, the first component could include the terminal 162, which is an input terminal for an input of the image signal IMG for driving the head 39, and the second component could include at least either the drive circuit board 130, on which at least any of the drive circuits 132-1 to **132-*n* configured to output the drive signals COMA and COMB for driving the head 39 is mounted, or the carriage motor 40**, which includes, as the drive motor, an electric motor that converts electric energy into kinetic energy.

The meaning of the phrase "operable for discharging ink onto the medium 22" is not limited to direct drive operation for discharging ink from the head 39 onto the medium 22 but includes incidental operation performed in the liquid discharging apparatus 1, too, such as, for example, input drive operation of inputting signals for discharging ink from the head 39 onto the medium 22, transportation drive operation of transporting the medium 22 onto which ink is discharged from the head 39, and head movement drive operation of moving the head 39 that discharges ink. In other words, the meaning of the phrase "operable for discharging ink onto the medium 22" includes indirect drive operation for discharging ink from the head 39 onto the medium 22, too.

In the liquid discharging apparatus 1 according to the present embodiment, the first control circuit board 110 drives the liquid discharging apparatus 1 by processing various control signals inputted for causing the liquid discharging apparatus 1 to discharge ink onto the medium 22. On the other hand, the second control circuit board 120 outputs a signal for moving the carriage 38 on which the head 39 is provided so as to cause the liquid discharging apparatus 1 to discharge ink onto the medium 22, a signal for transporting the medium 22, and a signal for generating the drive signal COMA, COMB for discharging ink from the head 39. That is, the first control circuit board 110 performs signal conversion processing for converting control signals inputted externally into signals for discharging ink onto the medium 22, and, based on the signals inputted from the first control circuit board 110, the second control circuit board 120 performs processing for causing various components to operate for discharging ink onto the medium 22.

Since the first control circuit board 110 and the second control circuit board 120 are configured to perform processing different from each other as explained above, they are different from each other in terms of the voltage levels and frequencies of the signals processed. For this reason, it is advantageous to arrange the first control circuit board 110 and the second control circuit board 120 at a distance from each other so as to avoid interference between the signals generated by the first control circuit board 110 and the signals generated by the second control circuit board 120.

Therefore, in the present embodiment, in order to arrange the first control circuit board 110 and the second control circuit board 120 at a distance from each other, the medium transportation region 41, including the transportation portion 45, where the medium 22 is transported is provided between the first control circuit board 110 and the second control circuit board 120. Specifically, the first control circuit board 110 is located on the −X side with respect to the medium transportation region 41 where the medium 22 is transported, and the second control circuit board 120 is located on the +X side with respect to the medium transportation region 41 where the medium 22 is transported. In other words, the first control circuit board 110 and the second control circuit board 120 are provided such that a minimum distance between the first control circuit board 110 and the second sidewall 14 is shorter than a minimum distance between the medium transportation region 41, including the transportation portion 45, and the second sidewall 14 and such that a minimum distance between the second control circuit board 120 and the first sidewall 13 is shorter than a minimum distance between the medium transportation region 41, including the transportation portion 45, and the first sidewall 13.

This structure makes it possible to arrange the first control circuit board 110 and the second control circuit board 120 configured to perform processing different from each other at a distance from each other inside the housing 10 of the liquid discharging apparatus 1. As a consequence, the risk of interference between the signals generated by the first control circuit board 110 and the signals generated by the second control circuit board 120 is reduced.

Besides a printing state, in which a print-demanded image is formed on the medium 22 by discharging ink from the head 39 onto the medium 22, the liquid discharging apparatus 1 has a standby state and a sleep state. In the standby state, in which power consumption is smaller than in the printing state, the image signal IMG is not inputted into the liquid discharging apparatus 1, and ink is not discharged from the head 39 onto the medium 22. In the sleep state, in which power consumption is smaller than in the standby state, the image signal IMG is not inputted into the liquid discharging apparatus 1, and ink is not discharged from the head 39 onto the medium 22. In other words, the liquid discharging apparatus 1 has the printing state, in which it is possible to discharge ink from the head 39, and the standby state and the sleep state, in both of which power consumption is smaller than in the printing state and in neither of which ink is discharged from the head 39.

In the liquid discharging apparatus 1 according to the present embodiment, as described earlier, the first control circuit board 110 performs signal conversion processing for converting control signals inputted externally into signals for discharging ink onto the medium 22, and, based on the signals inputted from the first control circuit board 110, the second control circuit board 120 performs processing for causing various components of the liquid discharging apparatus 1 to operate for discharging ink onto the medium 22. That is, the control circuit 121 provided on the second control circuit board 120 does not generate signals when in the standby state and when in the sleep state. Therefore, in at least one of the standby state and the sleep state, it is possible to stop the operation of the second control circuit board 120. For this reason, in the liquid discharging apparatus 1 according to the present embodiment equipped with the first control circuit board 110 and the second control circuit board 120, it is possible to further reduce power consumption in the standby state and the sleep state, in neither of which ink is discharged from the head 39, because the first control circuit board 110 and the second control circuit board 120 are configured to perform processing different from each other in the liquid discharging apparatus 1.

The printing state is an example of a first mode. At least one of the standby state and the sleep state is an example of a second mode.

6. Operational Effects

As explained above, the liquid discharging apparatus 1 according to the present embodiment includes the first control circuit board 110, on which the control circuit 111 is provided, and the second control circuit board 120, on which the control circuit 121 is provided. The operation portion 59 and the terminal 162, which are electrically coupled to the control circuit 111, are provided closer to the first control circuit board 110 than the second control circuit board 120, and the carriage motor 40 and the driver portion 33, which are electrically coupled to the control circuit 121, are provided closer to the second control circuit board 120 than the first control circuit board 110. That is, the minimum distance from the first control circuit board 110 to the operation portion 59 and to the terminal 162 is shorter than the minimum distance from the first control circuit board 110 to the carriage motor 40 and to the driver portion 33, and the minimum distance from the second control circuit board 120 to the carriage motor 40 and to the driver portion 33 is shorter than the minimum distance from the second control circuit board 120 to the operation portion 59 and to the terminal 162.

This structure makes it possible to shorten the length of wiring for signal propagation to each of the operation portion 59, the terminal 162, the carriage motor 40, the driver portion 33, which are scattered here and there inside the liquid discharging apparatus 1. The shorter wiring reduces the influence of wiring impedance between the operation portion 59, the terminal 162, the carriage motor 40, the driver portion 33 and the first control circuit board 110, the second control circuit board 120, resulting in greater signal propagation precision. This improves the discharge precision of ink discharged from the head 39. As a consequence, the risk of a decrease in the quality of an image formed on the medium 22 is reduced.

Although a certain exemplary embodiment is described above, the scope of the present disclosure is not limited thereto. The present disclosure can be modified in various ways within a scope of not departing from the gist thereof. For example, some examples in the foregoing embodiment may be combined as needed.

The scope of the present disclosure encompasses a structure that is substantially the same as the structure described in the embodiment (for example, a structure with the same function, method, and result, or a structure with the same object and effects). The scope of the present disclosure encompasses a structure that is obtained by replacing a non-essential part in the structure described in the embodiment with an alternative. The scope of the present disclosure encompasses a structure that produces the same operational effects as that of the structure described in the embodiment, or a structure that achieves the same object as that of the structure described in the embodiment. The scope of the present disclosure further encompasses a structure that is obtained by adding known art to the structure described in the embodiment.

What is claimed is:

1. A liquid discharging apparatus, comprising:

a discharging head that discharges liquid onto a medium by being driven;

first and second components that are operable for discharging the liquid onto the medium;

first and second control circuits that control driving of the discharging head;

a first control circuit board on which the first control circuit is provided;

a second control circuit board on which the second control circuit is provided;

a housing that houses the first component the second component, the first control circuit board and the second control circuit board; and a transportation section that transports the medium onto which the liquid is discharged from the discharging head;

wherein the first component is electrically coupled to the first control circuit, the second component is electrically coupled to the second control circuit, a minimum distance between the first control circuit board and the first component is shorter than a minimum distance between the first control circuit board and the second component, a minimum distance between the second control circuit board and the second component is shorter than a minimum distance between the second control circuit board and the first component, the housing had a first face and a second face, the first face and the second face are located with at least a partial overlap in a width direction of the medium intersecting with a transportation direction in which the medium is transported by the transportation section, a minimum distance between the first control circuit board and the first face is shorter than a minimum distance between the first control circuit board and the second face, and a minimum distance between the second control circuit board and the second face is shorter than a minimum distance between the second control circuit board and the first face.

2. The liquid discharging apparatus according to claim 1, wherein the minimum distance between the first control circuit board and the first face is shorter than a minimum distance between the transportation section and the first face, and the minimum distance between the second control circuit board and the second face is shorter than a minimum distance between the transportation section and the second face.

3. The liquid discharging apparatus according to claim 1, further comprising:

a drive signal output circuit that outputs a drive signal for driving the discharging head; and a drive circuit board on which the drive signal output circuit is provided; wherein the second component includes the drive circuit board.

4. The liquid discharging apparatus according to claim 1, wherein the second component includes an electric motor that converts electric energy into kinetic energy.

5. The liquid discharging apparatus according to claim 1, wherein the driving of the discharging head is controlled based on an image signal inputted from an input terminal, and the first component includes the input terminal.

6. The liquid discharging apparatus according to claim 1, wherein there are a first mode in which it is possible to discharge the liquid from the discharging head and a second mode in which power consumption is smaller than in the first mode and the liquid is not discharged from the discharging head, and operation of the second control circuit is stopped in the second mode.

* * * * *